US007623080B2

(12) United States Patent
Ogino et al.

(10) Patent No.: US 7,623,080 B2
(45) Date of Patent: Nov. 24, 2009

(54) LOOP ANTENNA ATTACHED TO REAR WINDOW OF VEHICLE

(75) Inventors: Kazushige Ogino, Kobe (JP); Yoshio Umezawa, Kobe (JP); Katsuhiro Tsuruta, Kobe (JP); Akihiro Fujiwara, Kobe (JP)

(73) Assignee: Fujitsu Ten Limited, Kobe-Shi, Hyogo (JP)

( * ) Notice: Subject to any disclaimer, the term of this patent is extended or adjusted under 35 U.S.C. 154(b) by 561 days.

(21) Appl. No.: 11/606,500

(22) Filed: Nov. 28, 2006

(65) Prior Publication Data

US 2007/0120756 A1 May 31, 2007

(30) Foreign Application Priority Data

Nov. 28, 2005 (JP) ..... 2005-342891
Apr. 28, 2006 (JP) ..... 2006-126652

(51) Int. Cl.
*H01Q 1/32* (2006.01)
*H01Q 1/02* (2006.01)

(52) U.S. Cl. ..... 343/713; 343/704

(58) Field of Classification Search ..... 343/704, 343/711, 713, 742, 893
See application file for complete search history.

(56) References Cited

U.S. PATENT DOCUMENTS 5,923,298 A * 7/1999 Miyahara et al. ..... 343/713
5,952,977 A * 9/1999 Taniguchi et al. ..... 343/713
6,002,373 A * 12/1999 Taniguchi et al. ..... 343/713
6,160,518 A * 12/2000 Miyahara et al. ..... 343/713

FOREIGN PATENT DOCUMENTS

| | | |
|---|---|---|
| JP | 08-162828 | 6/1996 |
| JP | 2002-118406 | 4/2002 |
| JP | 2005-101809 | 4/2005 |
| JP | 2005-102183 | 4/2005 |
| JP | 2005-151273 | 6/2005 |

OTHER PUBLICATIONS

Patent Abstracts of Japan, Publication 08-162828, Published Jun. 21, 1996, in the name of Kakizawa, et al.

(Continued)

*Primary Examiner*—Shih-Chao Chen
(74) *Attorney, Agent, or Firm*—Christie, Parker & Hale, LLP

(57) ABSTRACT

A loop antenna able to be mounted on the rear window of a vehicle provided with a defogger, that is, a loop antenna to be mounted on a rear window provided with a defogger having electrodes arranged in the vertical direction at the two ends and a plurality of electrical heating wires bridging the electrodes in the horizontal direction, wherein an antenna element forming a loop is made polygonal in shape, two power feed terminals of the loop antenna are provided at positions a predetermined distance away from the midpoint of the bottom of the antenna element, constituted by one side, in the vertical direction, a distance between the power feed terminals and bottom is formed smaller than the distance between adjoining electrical heating wires of the defogger, and the loop antenna is mounted on the rear window between the adjoining electrical heating wires. The polygonal shape may be a triangular shape.

21 Claims, 15 Drawing Sheets

OTHER PUBLICATIONS

Patent Abstracts of Japan, Publication 2002-118406, Published Apr. 19, 2002, in the name of Tabata, et al.
Patent Abstracts of Japan, Publication 2005-101809, Published Apr. 14, 2005, in the name of Maekawa, et al.
Patent Abstracts of Japan, Publication 2005-102183, Published Apr. 14, 2005, in the name of Ogino, et al.
Patent Abstracts of Japan, Publication 2005-151273, Published Jun. 9, 2005, in the name of Tomiyama, et al.

* cited by examiner

LOOP ANTENNA ATTACHED TO REAR WINDOW OF VEHICLE

CROSS-REFERENCE TO RELATED APPLICATIONS

This application claims priority from, and incorporates by reference the entire disclosure of, Japanese Patent Application No. 2005-342891, filed on Nov. 28, 2005, and No. 2006-126652, filed on Apr. 28, 2006.

BACKGROUND OF THE INVENTION

1. Field of the Invention

The present invention relates to a loop antenna attached to a rear window of a vehicle, more particularly relates to a loop antenna able to be installed on the rear window of a vehicle provided with a defogger, a method of mounting a loop antenna on a rear window of a vehicle, and a rear window of a vehicle provided with a loop antenna.

2. Description of the Related Art

Since the past, automobiles and other vehicles (moving bodies) have been equipped with antennas able to receive electromagnetic waves even during motion. The electromagnetic waves received by vehicles have for many years mainly been medium waves (MW) for AM radio use and very high frequency (VHF) or ultrahigh frequency (UHF) for FM radio use or television use. In recent years, GPS (global positioning system) antennas, antennas for receiving terrestrial wave digital broadcasts, and other antennas for sending and receiving high frequency band electromagnetic waves have become necessary in vehicles. Further, antennas for sending and receiving electromagnetic waves to and from beacons of electronic toll systems (ETC) and vehicle information communication systems (VICS) have become necessary in vehicles.

The location where an antenna is mounted when mounting an antenna on a moving body such as an automobile is generally the front window or rear window of the vehicle. When an antenna is mounted at the front window, the antenna is formed on a transparent film and this transparent film-like antenna is adhered to the inside of the front window of the automobile.

The adhesion of such a transparent film-like antenna at the front window of an automobile is described in for example Japanese Patent Publication (A) No. 2005-102183. The antenna described in this Japanese Patent Publication (A) No. 2005-102183 is an integrated antenna comprised of a transparent film formed with a GPS antenna, satellite digital broadcasting antenna, ETC antenna, TV broadcasting antenna, etc., that is, comprised of a film on which a plurality of antenna elements are formed by conductive ink, conductive foil, etc.

On the other hand, when an antenna is mounted on the rear window, the antenna is mostly placed at the rear window or the rear body at the rear of the vehicle. As the antenna in this case, a pole antenna is generally used. This reason is that the rear body of a vehicle is made of metal. The rear window is provided with a defogger comprised of electrical heating wires for defogging, so these end up having an effect on the reception of the electromagnetic waves. This makes mounting a sheet-like antenna there difficult.

However, a pole antenna installed at the rear body of a vehicle or the rear window sticks out from the body of the chassis, so ruins the appearance and therefore is not preferable design wise. Further, even if trying to set a film antenna at the rear window, it ends up being affected by the electrical heating wires of the defogger. In particular, digital TV broadcasts are horizontally polarized waves. The electrical heating wires of the defogger are arranged in the horizontal direction, so the defogger blocks the electromagnetic waves of the digital TV broadcasts. A film antenna adhered to the inside of the passenger compartment therefore has difficulty receiving the electromagnetic waves of digital TV broadcasts.

SUMMARY OF THE INVENTION

Therefore, an object of the present invention is to provide a loop antenna not sticking out from the body of the vehicle and with little degradation of performance even if installed on a dielectric material such as glass in which electrical heating wires are embedded, in particular a rear window of a vehicle provided with a defogger, a method of mounting a loop antenna on a vehicle, and a rear window of vehicle provided with a loop antenna.

To achieve this object, the loop antenna of the present invention can take the following three aspects.

A first aspect is a loop antenna mounted on a sheet of glass provided with a defogger comprised of a plurality of electrical heating wires bridging it in a horizontal direction, provided with an antenna element arranged in a polygonal shape, including a triangle, and forming a loop and power feed terminals of the loop antenna provided a predetermined distance from a bottom formed by one side of the antenna element, a distance between the power feed terminals and the bottom being formed smaller than a distance between adjoining electrical heating wires, the loop antenna able to be mounted to the glass sheet between the adjoining electrical heating wires.

A second aspect is a loop antenna mounted on a sheet of glass equipped with a defogger comprised of a plurality of electrical heating wires bridging it in a horizontal direction, provided with an antenna element provided with a bottom and two sides provided at the two sides of this bottom and extending vertically with respect to said bottom in the same direction and arranged in a polygonal shape with at least four sides to form a loop and two power feed terminals of said loop antenna provided at a position a predetermined distance from said bottom, a distance between said power feed terminals and said bottom being formed larger than a distance between adjoining electrical heating wires, said loop antenna able to be mounted on said glass sheet in a state with said sides perpendicularly intersecting said electrical heating wires.

A third aspect is a loop antenna mounted on a sheet of glass equipped with a defogger comprised of a plurality of electrical heating wires bridging it in a horizontal direction, provided with a plurality of loop antennas each having a polygonal loop having one side of an antenna element as a bottom and all having said bottoms arranged in parallel, two straight elements parallel to a line vertical to a midpoint of said bottom and connecting adjoining loop antennas, and at least one power feed terminal provided at each of the two sides of said line vertical to said bottom, a total length of an antenna element forming each said loop antenna being formed to a length equivalent to one wavelength of a frequency which said loop antenna sends and receives, a maximum value of a distance from said bottom to another antenna element separated in the vertical direction being smaller than a distance between said electrical heating wires, and said loop antenna able to be mounted to said glass sheet in a state with said straight elements perpendicularly intersecting said electrical heating wires.

Note that to have the loop antenna receive a lower frequency band than the received frequency band of the loop antenna, it is possible to provide a wire conductor made longer than ½ of the total length of the antenna element near the bottom of the antenna element. Conversely, to have the loop antenna receive a higher frequency band than the received frequency band of the loop antenna, it is possible to provide a wire conductor made shorter than ½ of the total length of the antenna element near the bottom of the antenna element.

The method of mounting the loop antenna to a vehicle of the present invention for achieving this object may take the following three forms.

A first aspect of a mounting method is a method of mounting a loop antenna to a rear window of a vehicle equipped with a defogger comprised of a plurality of electrical heating wires bridging it in a horizontal direction, comprising forming a loop antenna as set forth in the above first aspect on a single flexible dielectric sheet and providing one surface of said dielectric sheet with an adhesive material over its entire area and adhering said loop antenna, through said adhesive material, to an inside surface of said rear window at a region between adjoining electrical heating wires so that an antenna element positioned at a bottom runs along one of the electrical heating wires.

A second aspect of a mounting method is a method of mounting a loop antenna to a rear window of a vehicle equipped with a defogger comprised of a plurality of electrical heating wires bridging it in a horizontal direction, comprising forming a loop antenna as set forth in the above second aspect on a single flexible dielectric sheet and providing one surface of said dielectric sheet with an adhesive material over its entire area and adhering said loop antenna, through said adhesive material, to an inside surface of said rear window at a region between two electrical heating wires adjoining one electrical heating wire so that one side perpendicularly intersects said one electrical heating wire.

A third aspect of the mounting method is a method of mounting a loop antenna to a rear window of a vehicle equipped with a defogger comprised of a plurality of electrical heating wires bridging it in a horizontal direction, comprising forming a loop antenna as set forth in the above third aspect on a single flexible dielectric sheet and providing one surface of said dielectric sheet with an adhesive material over its entire area and adhering said loop antenna, through said adhesive material, to an inside surface of said rear window at a region between two electrical heating wires adjoining one electrical heating wire so that said straight elements perpendicularly intersect said one electrical heating wire.

Explaining the third aspect of the mounting method in more detail, this comprises laminating an adhesive material on a surface of said loop antenna for mounting to a glass sheet, attaching a release paper liner of a size larger than said loop antenna to said mounting surface, giving the surface of said loop antenna at the opposite side to said mounting side a size enabling overlay on said release paper liner, and overlaying an applicator with an adhesive material laminated on its overlay surface and with intersecting positioning marks printed on the opposite side so as to form a loop antenna assembly, positioning a center of an attachment position of said loop antenna at a point overlaying a predetermined single electrical heating wire among said electrical heating wires, attaching masking tape to said rear window while matching one side of said masking tape to a line vertical to this electrical heating wire passing through the center point so as to set said single electrical heating wire as a horizontal axis and one side of said masking tape as a vertical axis, placing said loop antenna assembly on said rear window in a state with said release liner at the rear window surface side and with said positioning marks aligned with said horizontal axis and vertical axis, removing part of said release liner while holding this state and using the adhesive material of said applicator overlaying the removed part to temporarily fasten said loop antenna assembly on said rear window, removing said masking tape, then peeling off said release paper liner to adhere said loop antenna by the adhesive material to the rear window, and finally peeling off the applicator from said loop antenna.

A rear window of a vehicle provided with a loop antenna of the present invention for achieving the above object is a rear window for securing a rear field of vision of a vehicle, wherein when a defogger with electrodes arranged at the two ends in a vertical direction and with a plurality of electrical heating wires bridging said electrodes in a horizontal direction is mounted at an inside of said rear window, said rear window has at least one of the loop antennas set forth in the first to third aspects of the invention embedded inside it, in the case of the loop antenna as set forth in the first aspect, said loop antenna is embedded, with respect to a mounting position of said defogger in said rear window, in a region between adjoining electrical heating wires of said defogger so that the antenna element positioned at the bottom of said loop antenna runs along said electrical heating wires, in the case of the loop antenna as set forth in the second aspect, said loop antenna is embedded, with respect to a mounting position of said defogger in said rear window, in a region between two electrical heating wires adjoining one electrical heating wire of said defogger so that sides of said loop antenna perpendicularly intersect said one electrical heating wire, and in the case of the loop antenna as set forth in the third aspect, said loop antenna is embedded, with respect to a mounting position of said defogger in said rear window, in a region between two electrical heating wires adjoining one electrical heating wire of said defogger so that said straight elements of said loop antenna perpendicularly intersect said one electrical heating wire.

As explained above, the loop antenna of the present invention can be installed at the rear window of a vehicle, so does not detract from the appearance of the vehicle. Further, according to the method of mounting a loop antenna to a vehicle of the present invention, a film shaped antenna can be installed at a rear window of a vehicle provided with a defogger. Further, the rear window provided with a loop antenna of the present invention can mount a defogger at the surface of this rear window inside the passenger compartment without impairing the performance of the loop antenna.

BRIEF DESCRIPTION OF THE DRAWINGS

The present invention is illustrated by way of example, and not limitation, in the figures of the accompanying drawings in which like references indicate similar elements. Note that the following figures are not necessarily drawn to scale. In the figures.

DESCRIPTION OF THE PREFERRED EMBODIMENTS

Below, the attached drawings will be used to explain in detail the loop antenna, the method of mounting the loop antenna to a vehicle, and a rear window of a vehicle provided with a loop antenna of the present invention based on specific embodiments. Note that here the location where the loop antenna is installed will be explained with reference to the rear window of a vehicle.

Figure 1A:
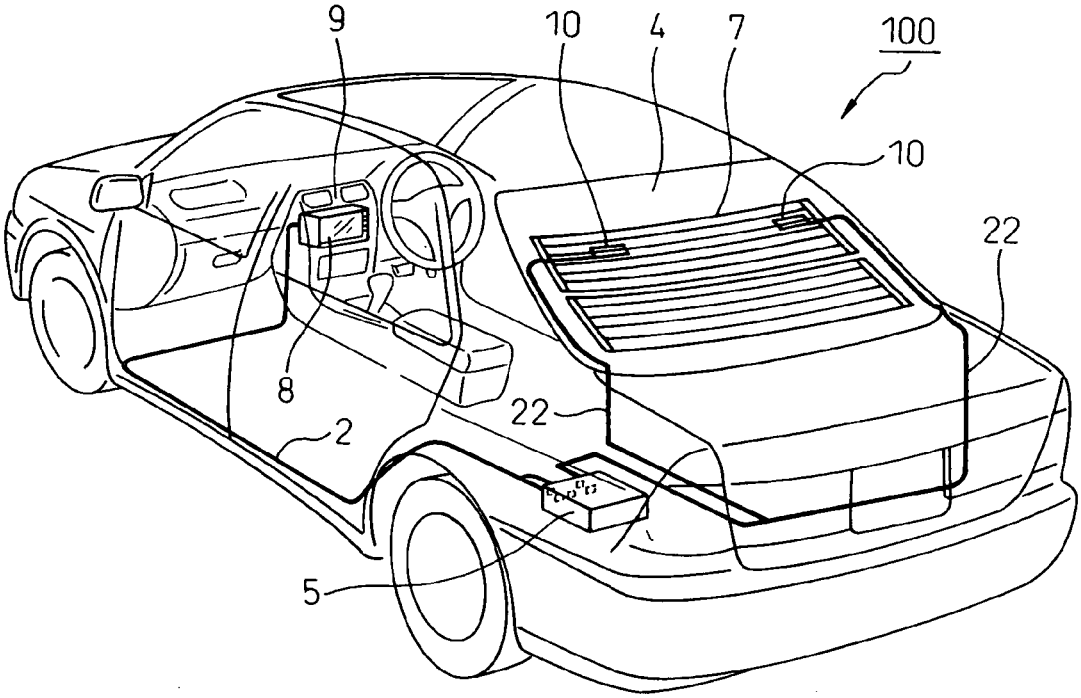
FIG. 1A is a perspective view of a sedan type vehicle provided with loop antennas of the present invention at a rear window.

FIG. 1A shows a sedan type vehicle 100 provided with loop antennas 10 according to an embodiment of the present invention at a rear window 4 in a see through manner. The automobile 100 mounts a TV tuner 5 for receiving a terrestrial wave digital television broadcast (television hereinafter being referred to as a "TV") under the rear seats. The instrument panel 9 is provided with a car navigation system 8 (hereinafter referred to as a "navigation system 8").

The loop antennas of the present invention 10 are provided at regions of the rear window 4 of the automobile 100 where a defogger 7 is provided and, for example, receive a terrestrial wave digital TV broadcast. Here, the loops are rectangular in shape. Loop antennas 10 of a second embodiment explained later are shown. The loop antennas 10 of this example are arranged straddling electrical heating wires of the defogger 7 and are connected to the TV tuner 5 installed under the rear seat of the automobile 100 etc. by coaxial cables 22. Further, the signal (image) received by the TV tuner 5 is input to the navigation system 8 provided at the instrument panel 9 by a cable 2, whereby the navigation system 8 displays the received image at its display device in the TV mode.

Figure 1B:
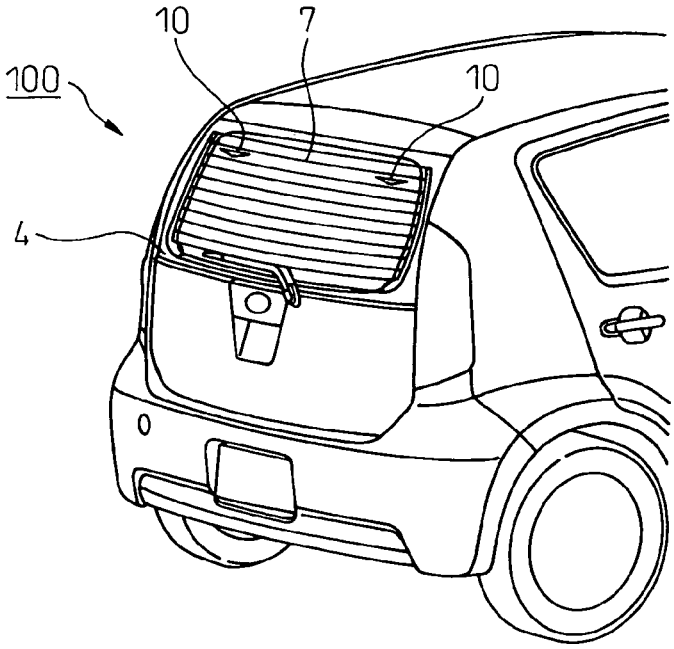
FIG. 1B is a perspective view of a rear of a hatchback type automobile provided with loop antennas of the present invention at a rear window.

FIG. 1B shows another example of installation of loop antennas 10 according to an embodiment of the present invention in an automobile. In this example, loop antennas 10 are provided at the rear window 4 of a hatchback type automobile 100 where a defogger 7 is provided. This figure shows loop antennas of a first embodiment explained later. The loops are triangular in shape. In this way, the loop antennas of the present invention 10 are mainly provided at the rear window 4 of the automobile where the defogger 7 is provided.

Figure 2:
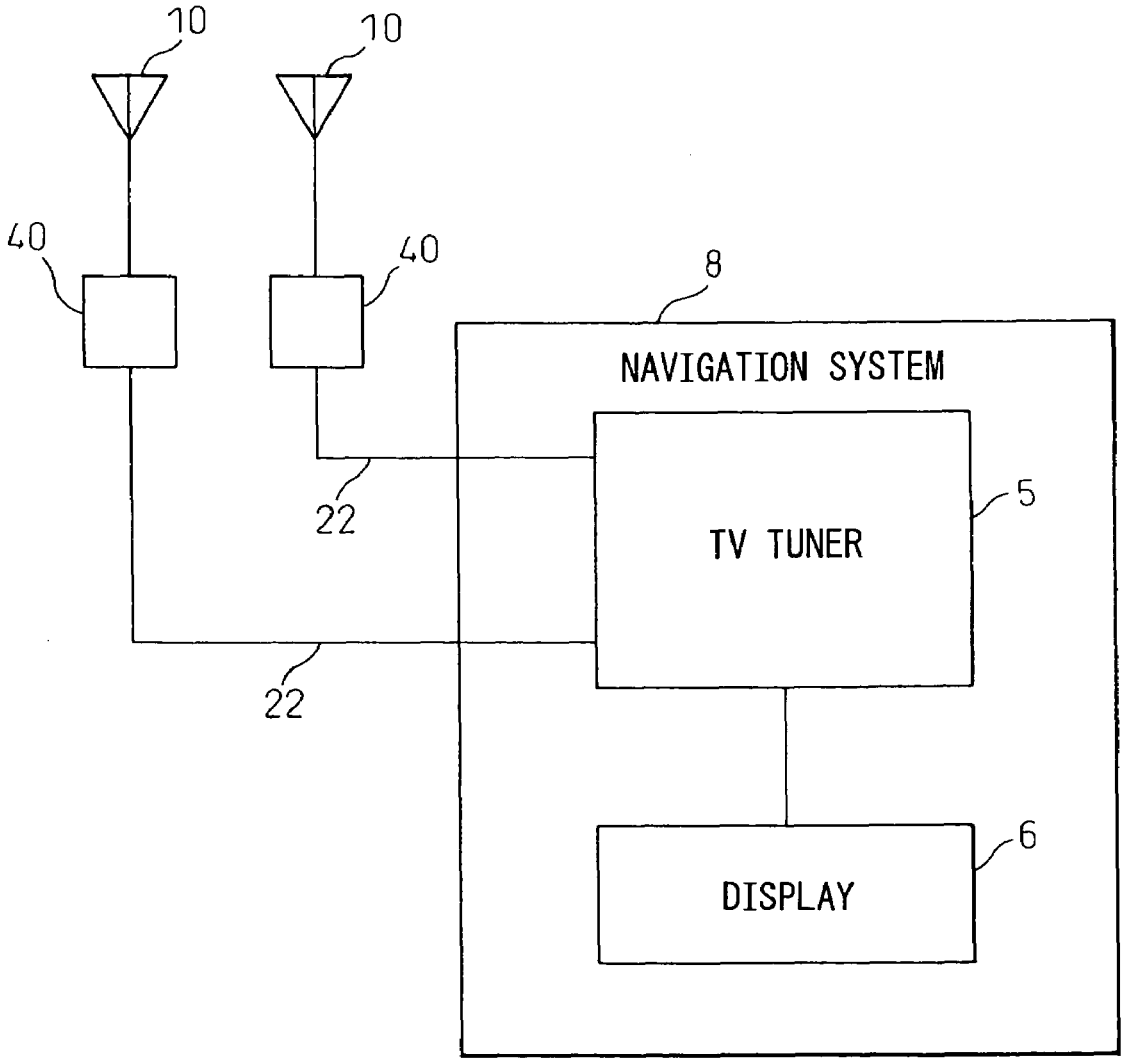
FIG. 2 is a block circuit diagram showing the connections of the two loop antennas of FIG. 1A and FIG. 1B to a navigation system.

FIG. 2 is a block circuit diagram showing an example of the configuration of a navigation system 8 as a receiver using loop antennas 10 of the present invention. In the example shown in FIG. 1A, the TV tuner 5 was separate from the navigation system 8, but in this example, the TV tuner 5 is built into the navigation system 8. When the loop antennas 10 are antennas receiving a terrestrial digital TV wave, the signals received by the loop antennas 10 are guided through an integrated circuit 40 built into a later explained connector and performing amplification etc. and a cable 22 to the TV tuner 5. The demodulated image is then displayed by the navigation system 8 on its display device 6 at the time of the TV mode. Note that this embodiment shows only the case where the TV tuner 5 built into the navigation system 8 is connected to the loop antennas 10. The rest of the configuration of the navigation system 8 is not illustrated or explained. This is because even if the loop antennas 10 are GPS antennas or satellite digital broadcast antennas, the circuit up to the receiver is not that different from this embodiment.

Figure 3A:
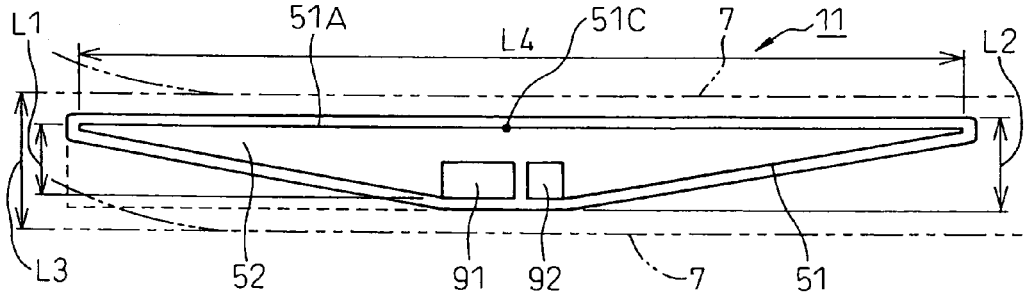
FIG. 3A is a plan view showing the configuration of a first embodiment of a loop antenna of the present invention shown against a defogger.

FIG. 3A shows the configuration of a loop antenna 11 of a first embodiment of the present invention compared with the defogger 7. The loop antenna 11 of the first embodiment is comprised of a transparent flexible triangular shaped sheet-like film (dielectric sheet) 52 on which a triangular shaped antenna element 51 is formed. In the loop antenna 11 of the first embodiment, when one side of the triangular shaped antenna element 51 is designated as a bottom 51A, two power feed terminals 91, 92 of the loop antenna 11 are provided at positions a predetermined distance L1 away from the midpoint 51C of the bottom 51A in the vertical direction. The distance L1 between the power feed terminals 91, 92 and the bottom 51A is formed smaller than the distance L3 between the adjoining electrical heating wires of the defogger 7. As a result, the loop antenna 11 of the first embodiment is mounted in a region between adjoining electrical heating wires of the defogger 7 installed at the rear window of the automobile. Further, the antenna element 51 is formed on the flexible sheet-like film 52, so even if the surface on which the loop antenna 11 is mounted is curved, it can be handled.

Note that the length L2 of the triangular shaped sheet-like film 52 in the direction of the distance between the electrical heating wires of the defogger 7 is, in this embodiment, formed smaller than the distance L3 between the adjoining electrical heating wires of the defogger 7, but this length L2 may also be longer than the length L3. Further, the loop antenna 11 of a first embodiment has an antenna element 51 of a triangular shape, but this is so that even if the loop antenna 11 is mounted on a curved part of the defogger 7, part of the antenna element 51 will not intersect the curved part of the electrical heating wires of the defogger 7. That is, if the antenna element 51 were shaped rectangularly as shown by the broken line, if the loop antenna 11 were mounted on the curved part of the defogger 7, part of the loop antenna 11 would overlap the curved part of the electrical heating wires of the defogger 7 at the rear window and part of the antenna element 51 would intersect the curved part of the electrical heating wires of the defogger 7.

From the above, in the present embodiment, it is preferable to shape the polygonally configured antenna element 51 by inclined sides at only the locations liable to overlap the electrical heating wires of the defogger 7 at the time of mounting. Further, in general the distance L3 between the adjoining electrical heating wires of the defogger 7 is 30 mm or so, so the distance L1 between the power feed terminals 91, 92 and bottom 51A should be 15 mm or more. The length L4 of the bottom 51A should be a length of half ($\lambda/2$) of one wavelength of the frequency or the center frequency of the frequency band which the loop antenna 11 receives.

Figure 3B:
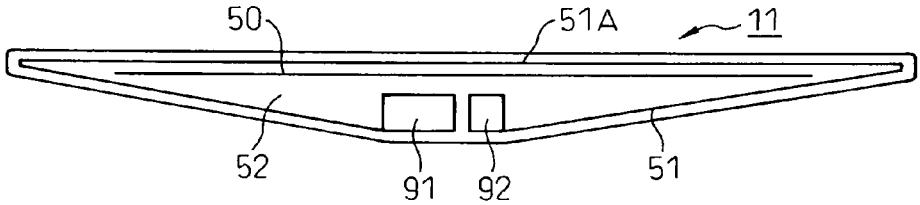
FIG. 3B is a plan view showing the configuration of a modified embodiment adding a nonpower feed terminal to an inside of a loop shaped antenna element of the loop antenna of FIG. 3A.

FIG. 3B shows the configuration of a modified embodiment adding a nonpower feed terminal 50 formed by a wire conductor independent from the antenna element 51 at the inside of the loop shaped antenna element 51 of the loop antenna 11 of FIG. 3A. The nonpower feed terminal 50 is provided in parallel with the bottom 51A of the antenna element 51. This nonpower feed terminal 50 is provided to increase the reception efficiency of the loop antenna 11 or increase the received band. The total length of the antenna element 51 in this case is preferably a length corresponding to one wavelength ($\lambda$) of the frequency received by the loop antenna 11 or the center frequency of the frequency band received. The nonpower feed terminal 50 may be provided at a part closer to the direction of arrival of the electric wave than the surface where the loop antenna 11 is installed.

Figure 3C:
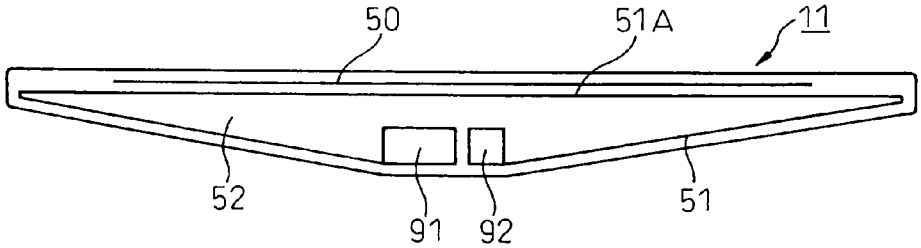
FIG. 3C is a plan view showing the configuration of a modified embodiment adding a nonpower feed terminal to an outside of a loop shaped antenna element of the loop antenna of FIG. 3A.

FIG. 3C shows the configuration of a modified embodiment adding a nonpower feed terminal 50 at the outside of the loop shaped antenna element 51 of the loop antenna 11 of FIG. 3A. In this example as well, the nonpower feed terminal 50 is provided in parallel to the bottom 51A of the antenna element 51. Even when the nonpower feed terminal 50 is provided at the outside of the antenna element 51, the total length of the nonpower feed terminal 50 is preferably less than $\lambda/2$ of the frequency which the loop antenna 11 receives.

Figure 3D:
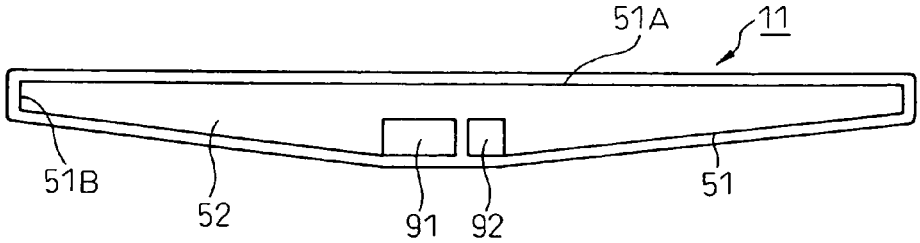
FIG. 3D is a plan view showing the configuration of a modified embodiment making the loop of the loop antenna of FIG. 3A pentagonal in shape.

FIG. 3D shows the configuration of a modified embodiment in which the loop of the loop antenna 11 of FIG. 3A is made pentagonal in shape. In this embodiment, sides 51B are provided at the two ends of the antenna element 51, but the distance L1 between the bottom 51A and the power feed terminals 91, 92 (see FIG. 3A) is still shorter than the distance L3 between the adjoining electrical heating wires of the defogger 7 (see FIG. 3A).

Figure 4A:
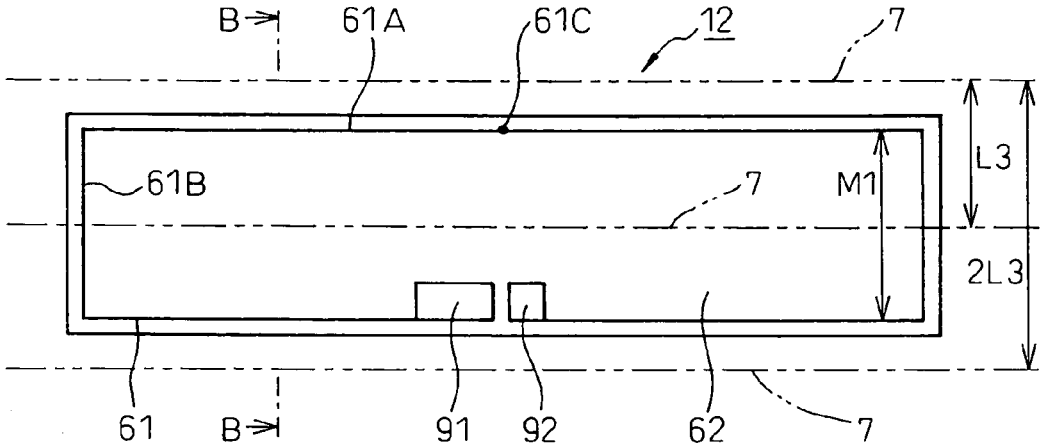
FIG. 4A is a plan view showing the configuration of a second embodiment of a loop antenna of the present invention shown against a defogger.

FIG. 4A shows the configuration of the loop antenna 12 of a second embodiment of the present invention compared with the defogger 7. The loop antenna 12 of the second embodiment is comprised of a transparent rectangular sheet-like film (dielectric sheet) 62 on which a rectangular antenna element 61 is formed. In the loop antenna 12 of the second embodiment, one side of the rectangular antenna element 61 is designated as a bottom 61A. When the two sides of the antenna element 61 are designated as the sides 61B, the two power feed terminals 91, 92 of the loop antenna 12 are provided at positions a predetermined distance M1 away from the midpoint 61C of the bottom 61A in the vertical direction. The distance M1 between the power feed terminals 91, 92 and the bottom 61A is formed to be at least the distance L3 between the adjoining electrical heating wires of the defogger 7 and smaller than the distance 2L3 of double that. Note that when L1=L3 is the best.

As a result, when the loop antenna 12 of the second embodiment is mounted so that the bottom 61A becomes parallel to one of the electrical heating wires of the defogger 7 mounted on the rear window of the automobile, the sides 61B perpendicularly intersect one of the adjoining electrical heating wires of the defogger 7. In this case, the sides 61B preferably perpendicularly intersect one of the electrical heating wires of the defogger 7 at the midpoint. In this state, the loss of the loop antenna 12 is the smallest.

Figure 4B:
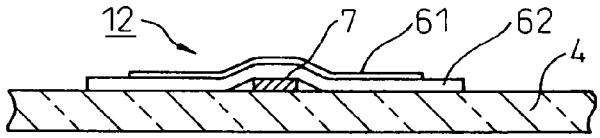
FIG. 4B is a cross-sectional view along the line B-B of FIG. 4A.

FIG. 4B is a cross-sectional view along the line B-B of FIG. 4A. Reference numeral 4 indicates the rear window, while 7 indicates an electrical heating wire of a defogger. The sheet-like film 62 of the loop antenna 12 where the antenna element 61 is provided is adhered to the back surface of the rear window 7 straddling an electrical heating wire of the defogger 7 (inside of passenger compartment).

Figure 4C:
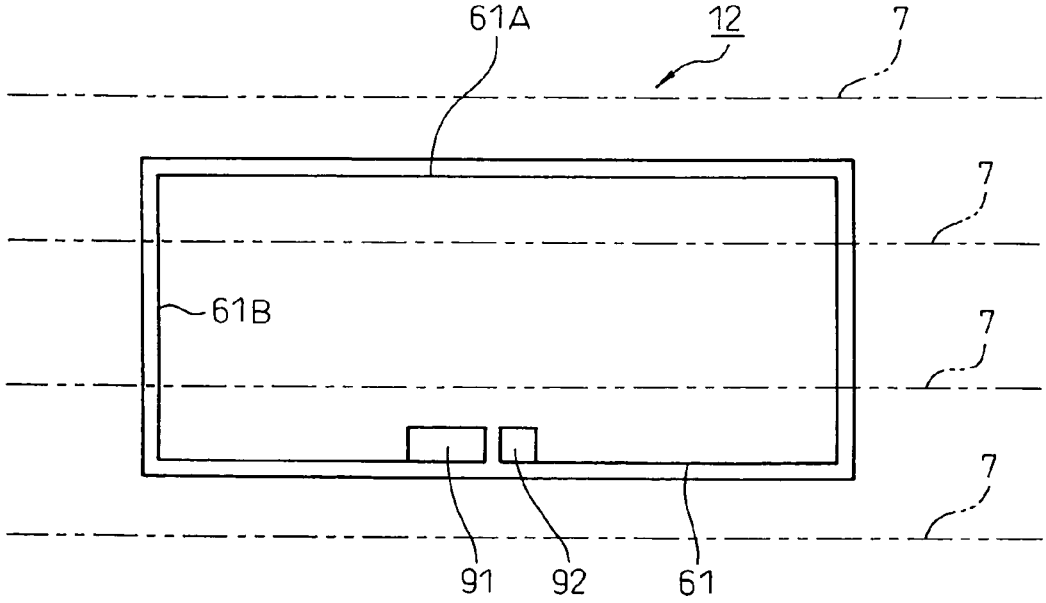
FIG. 4C is a plan view showing the configuration of a modified embodiment of a loop antenna of FIG. 4A.

FIG. 4C shows the configuration of a modified embodiment of the loop antenna 12 of FIG. 4A. In the embodiment shown in FIG. 4A, the sides 61B perpendicularly intersect one electrical heating wire of the defogger 7, but the sides 61B of this embodiment are formed longer and intersect two electrical heating wires of the defogger 7. In this way, the length of the loop antenna 12 in the direction perpendicularly intersecting the electrical heating wires of the defogger 7 is not particularly limited.

Figure 5A:
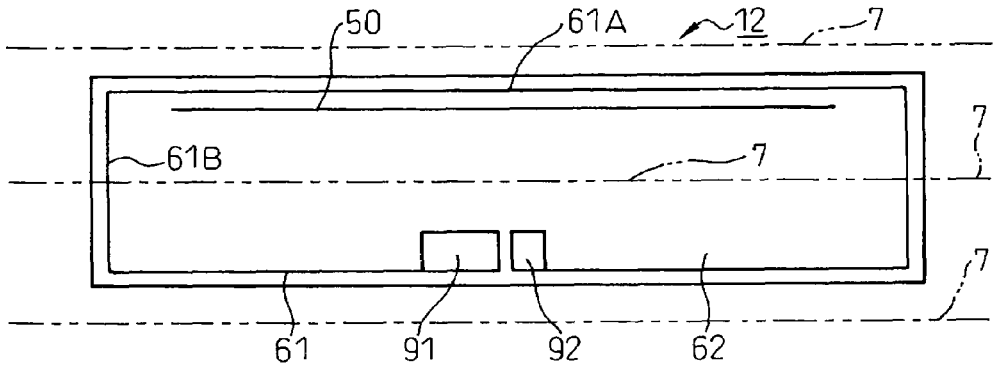
FIG. 5A is a plan view showing the configuration of a modified embodiment adding a nonpower feed terminal to an inside of a loop shaped antenna element of the loop antenna of FIG. 4A.

FIG. 5A shows the configuration of a modified embodiment adding a nonpower feed terminal 50 independent from the antenna element 61 at the inside of the loop shaped antenna element 61 of the loop antenna 12 shown in FIG. 4A. The nonpower feed terminal 50 is provided in parallel to the bottom 61A of the antenna element 61. This nonpower feed terminal 50 is provided to increase the reception efficiency of the loop antenna 12 or broaden the received band.

Figure 5B:
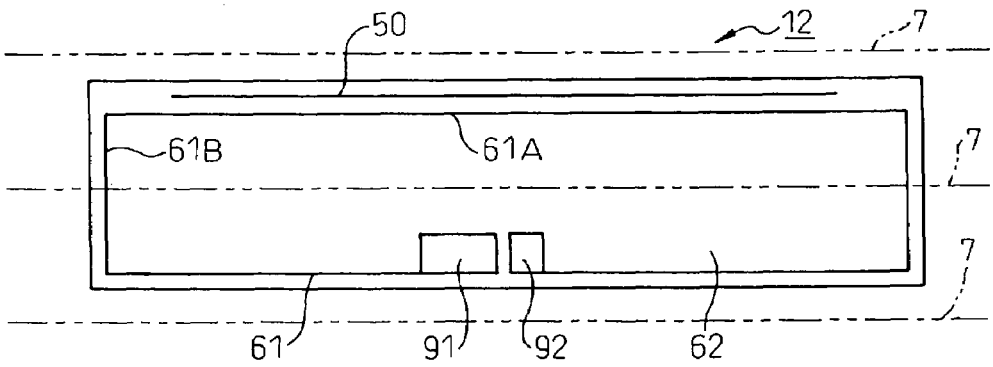
FIG. 5B is a plan view showing the configuration of a modified embodiment adding a nonpower feed terminal to an outside of a loop shaped antenna element of the loop antenna of FIG. 4A.

FIG. 5B shows the configuration of a modified embodiment adding a nonpower feed terminal 50 at the outside of the loop shaped antenna element 61 of the loop antenna 12 shown in FIG. 4A. The nonpower feed terminal 50 is provided in parallel to the bottom 61A of the antenna element 61.

Figure 5C:
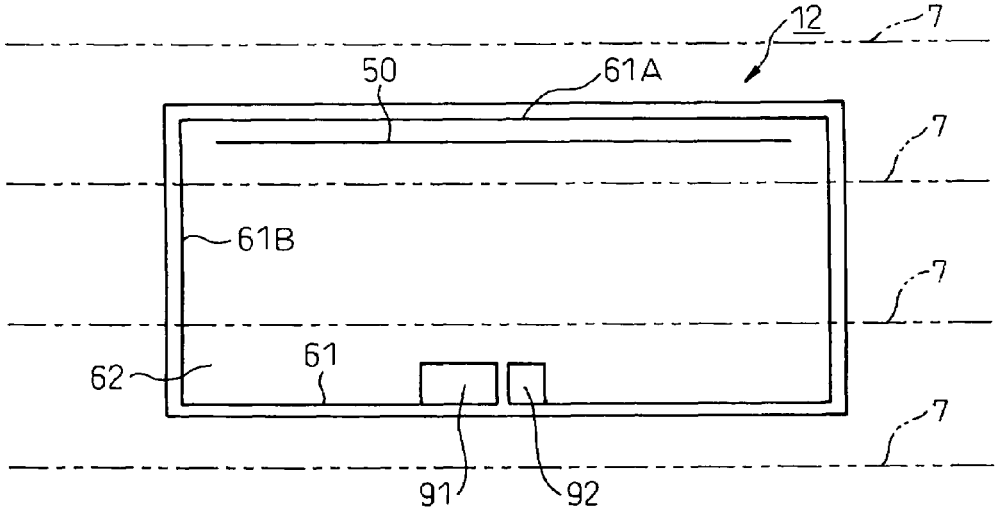
FIG. 5C is a plan view showing the configuration of a modified embodiment adding a nonpower feed terminal to an inside of a loop shaped antenna element of the loop antenna of FIG. 4C.

FIG. 5C shows the configuration of a modified embodiment adding a nonpower feed terminal 50 at the inside of the loop shaped antenna element 61 of the loop antenna 12 shown in FIG. 4C. The nonpower feed terminal 50 is provided in parallel to the bottom 61A of the antenna element 61.

Figure 6A:
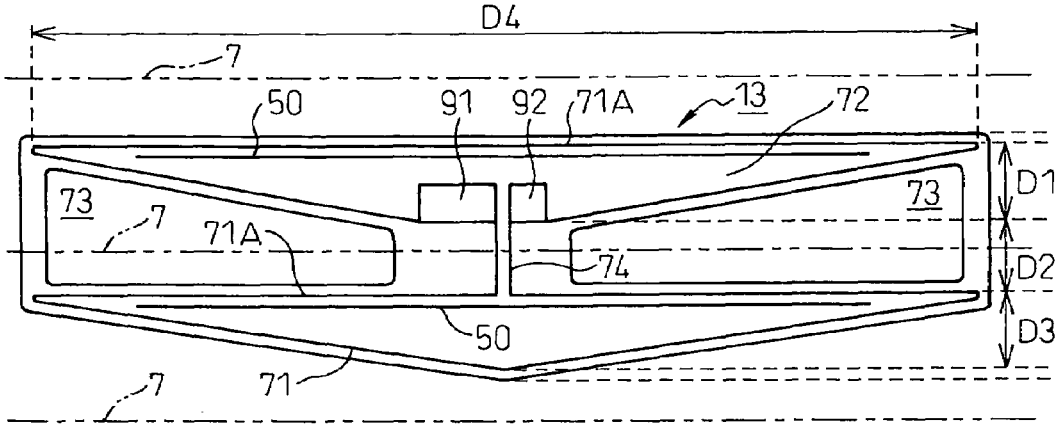
FIG. 6A is a plan view showing the configuration of a third embodiment of a loop antenna of the present invention shown against a defogger.

FIG. 6A shows the configuration of a loop antenna 13 of a third embodiment of the present invention compared with the defogger 7. The loop antenna 13 of the third embodiment is comprised of a transparent pentagonal sheet-like film (dielectric sheet) 72 on which two triangular shaped antenna elements 71 are formed arranged in the vertical direction. In the loop antenna 13 of the third embodiment, when making single sides of the triangular shaped antenna elements 71 as the bottoms 71A, the two triangular shaped antenna elements 71 are arranged with the bottoms 71A in parallel.

One triangular shaped antenna element 71 is provided with two power feed terminals 91, 92 arranged near its vertex. The other triangular shaped antenna element 71 is electrically connected to the vertex. The element is split near the midpoint of the bottom 71A. The split ends are connected by straight elements 74 to the two power feed terminals 91, 92. Further, the sheet-like film 72 is provided with openings 73 at the two sides of the straight elements 74.

In this embodiment, the distance D1 from the bottom 71A of the one triangular shaped antenna element 71 to the two power feed terminals 91, 92, the length D2 of the straight elements 74, and the distance D3 from the bottom 71A of the other triangular shaped antenna element 71 to the vertex are the same lengths and are formed smaller than the distance between adjoining electrical heating wires of the defogger 7. Further, the loop antenna 13 of the third embodiment is mounted to the rear window so that the one triangular shaped antenna element 71 and the other triangular shaped antenna element 71 are provided in the region between the adjoining electrical heating wires of the defogger 7 and so that the straight elements 74 perpendicularly intersect the electrical heating wires of the defogger 7. The straight elements 74 and the electrical heating wires of the defogger 7 preferably perpendicularly intersect.

Further, the length D4 of the bottoms 71A should be made $\lambda/2$ of the frequency received by the loop antenna 13. Further, the loop antenna 13 of this embodiment is provided with nonpower feed terminals 50 inside the two triangular shaped antenna elements 71. In this example as well, the nonpower feed terminals 50 are provided in parallel to the bottoms 71A of the antenna elements 71.

Figure 6B:
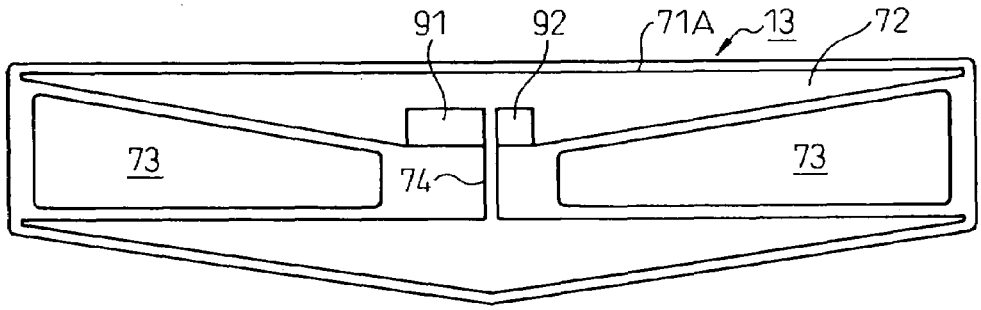
FIG. 6B is a plan view showing the configuration of a modified embodiment deleting the nonpower feed terminal from the loop shaped antenna element of the loop antenna of FIG. 6A.

FIG. 6B shows the configuration of a modified embodiment eliminating the nonpower feed terminals 50 from two loop shaped antenna elements 71 of the loop antenna 13 explained in FIG. 6A. The rest of the configuration is the same as the loop antenna 13 explained in FIG. 6A. Here, the explanation will therefore be omitted.

Figure 6C:
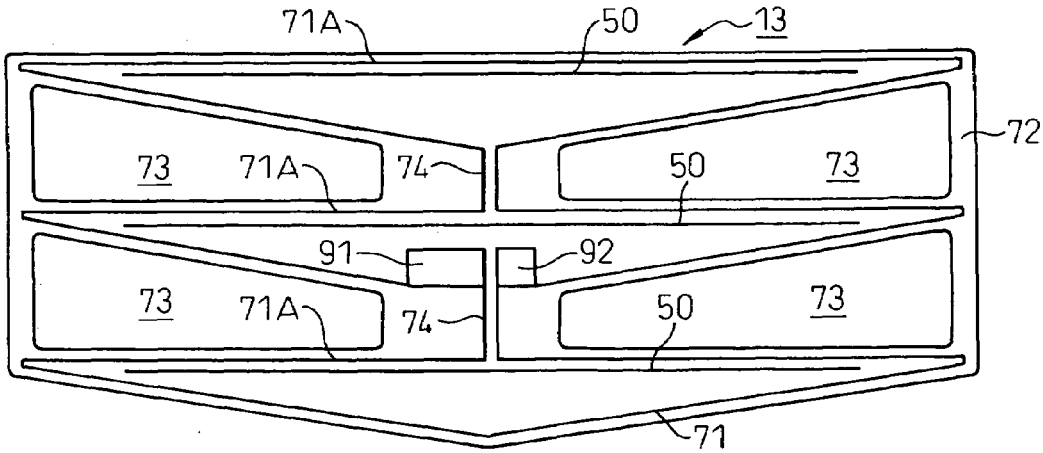
FIG. 6C is a plan view showing the configuration of a modified embodiment connecting three loop shaped antenna elements of the loop antenna of FIG. 6A.

FIG. 6C shows the configuration of a modified embodiment connecting three of the loop shaped antenna elements 71 of the loop antenna 13 explained in FIG. 6A. In this embodiment, three antenna elements 71 of the same shape are arranged with their bottoms 71A in parallel. Straight elements 74 of the same length are used to connect the antenna elements 71 with each other in the same way as explained in FIG. 6A. Further, the power feed terminals 91, 92 are provided at only the vertex of the center antenna element 71. The loop antenna 13 of this embodiment is attached to the rear window so that the antenna elements 71 are arranged in the regions between the adjoining electrical heating wires of the defogger 7 and so that the straight elements 74 perpendicularly intersect the electrical heating wires of the defogger 7. The straight elements 74 and the electrical heating wires of the defogger 7 preferably perpendicularly intersect. The loop antenna 13 of this embodiment also provides nonpower feed terminals 50 inside the three triangular shaped antenna elements 71. The nonpower feed terminals 50 are provided in parallel to the bottoms 71A of the antenna elements 71.

Figure 7A:
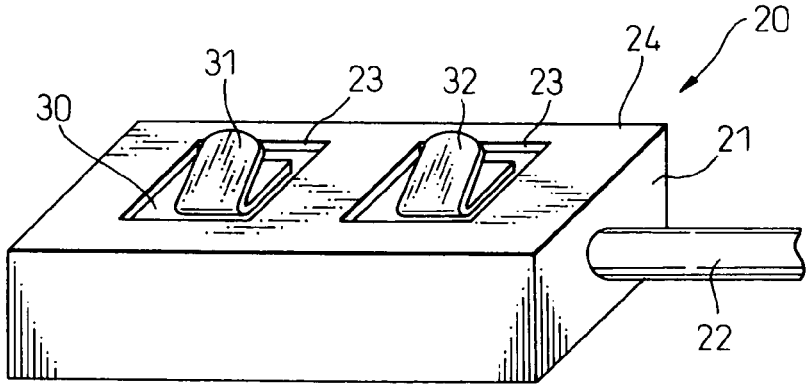
FIG. 7A is a perspective view showing the appearance of a connector part and coaxial cable connected to a power feed terminal of a loop antenna of the present invention shown from FIG. 3A to FIG. 6C.

FIG. 7A shows the appearance of a connector 20 connected to the power feed terminals 91, 92 of the loop antennas 11 to 13 of the present invention shown from FIG. 3A to FIG. 6C. The bottom (surface for mounting to antenna) 24 of the housing 21 of the connector 20 has two openings 23. Connection terminals 31 and 32 having springiness stick out from these openings 23. The connection terminals 31, 32 are attached to a circuit board (dielectric board) 30 built in the housing 21. This circuit board 30 is connected to a coaxial cable 22.

The connector 20 is attached at the bottom 24 to the power feed terminals 91, 92 of the loop antennas 11 to 13 of the present invention shown from FIG. 3A to FIG. 6C using two-sided tape or other adhesive. In this embodiment, the connection terminal 31 is a terminal at the hot side (signal transmission side), while the connection terminal 32 is a terminal of the ground side. The power feed terminals 91, 92 of the loop antennas 11 to 13 shown from FIG. 3A to FIG. 6C are configured so that the power feed terminals 91, 92 are hidden by the housing 21 of the connector 20 when the connector 20 is correctly attached.

Figure 7B:
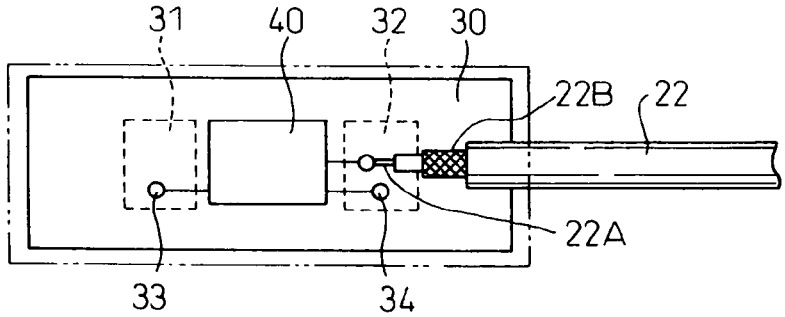
FIG. 7B is a plan view showing the configuration of a circuit board at the inside of the connector shown in FIG. 7A.

FIG. 7B shows the configuration of the circuit board 30 inside the connector 20 shown in FIG. 7A minus the housing 21. The connection terminals 31, 32 are attached to the back surface of the circuit board 30, are guided through the through holes 33, 34 to the front surface of the circuit board 30, and are connected to the circuit (integrated circuit) 40 attached to the front surface of the circuit board 30, whereby the signal received by the loop antenna is amplified and otherwise processed. The coaxial cable 22 is connected at its center conductor 22A to the circuit 40 and is connected at its ground wire (outer conductor) 22B to the ground side connection terminal 32 on the circuit board 30.

Figure 7C:
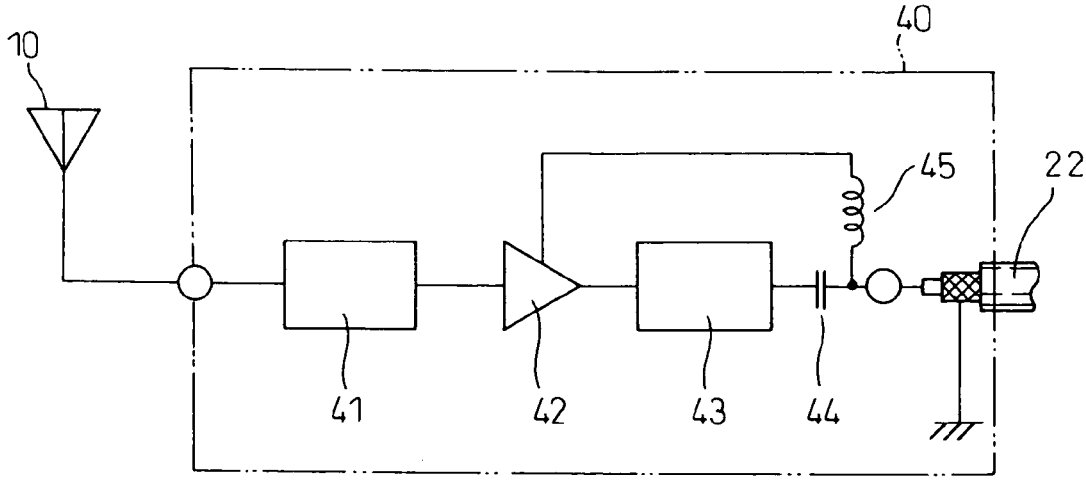
FIG. 7C is a block circuit diagram showing the internal configuration of the circuit shown in FIG. 7B.

FIG. 7C shows the internal configuration of the circuit 40 shown in FIG. 7B. Inside the circuit 40, there are a filter 41 connected to the loop antenna 10, an amplifier 42 amplifying the signal output from the filter 41, and a filter 43 determining the signal band output from the amplifier 42. This filter 43 is connected to the center conductor of the coaxial cable 22 through a capacitor 44 blocking a direct current. This coaxial cable 22 is a cable including a power line. The power source voltage is run through a coil 45 (blocking alternating current component) and supplied to the amplifier 42.

Figure 8A:
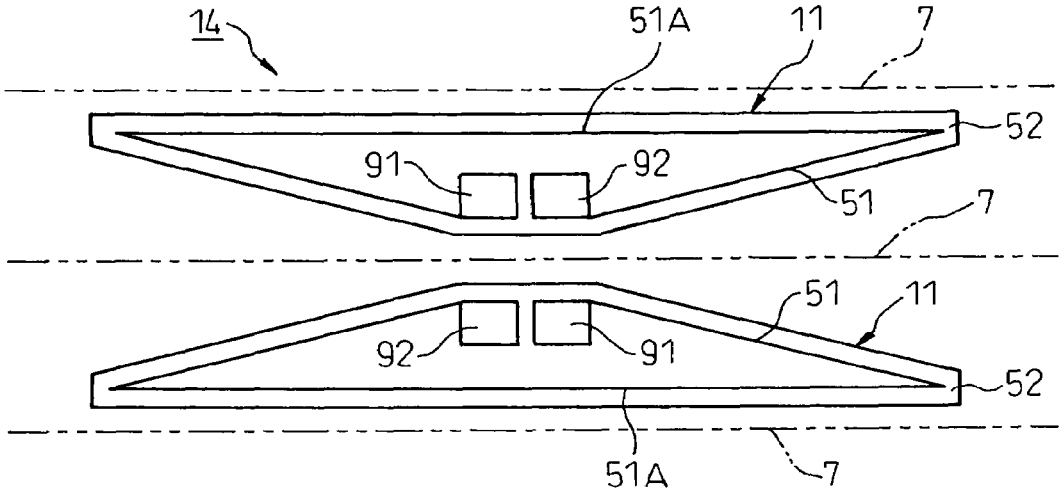
FIG. 8A is a plan view showing the configuration of a fourth embodiment combining two loop antennas of the first embodiment shown in FIG. 3A shown against a defogger.

FIG. 8A shows the configuration of a loop antenna 14 of a fourth embodiment of the present invention comprised of two of the loop antennas 11 of the first embodiment of the present invention shown in FIG. 3A in combination shown against a defogger 7. The loop antenna 14 of this embodiment is comprised of two loop antennas 11 of the above-mentioned first embodiment straddling the defogger 7 between the electrical heating wires of the defogger. The power feed terminals 91, 92 provided at the two loop antennas 11 are arranged in proximity straddling the defogger 7. The four power feed terminals 91, 92 can be connected by one connector.

Figure 8B:
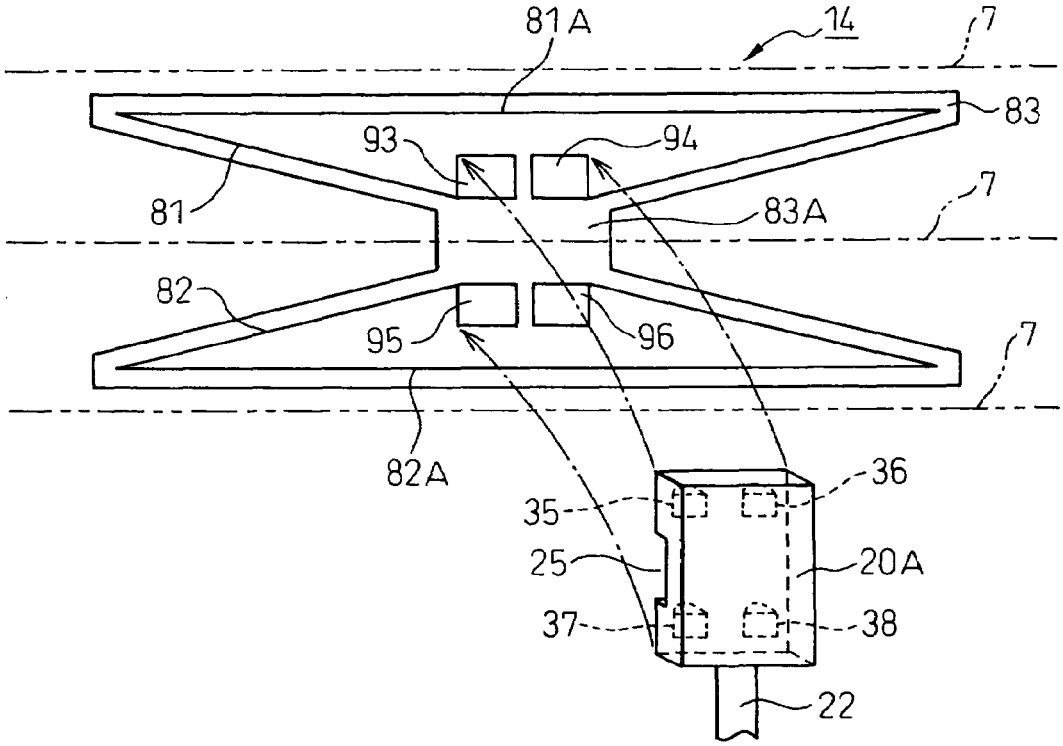
FIG. 8B is an explanatory view showing provision of independent antenna elements of the loop antenna shown in FIG. 8A as the first antenna element and second antenna element on a single film sheet together with a connector connecting the same.

FIG. 8B shows the independent antenna elements 11 of the loop antenna 14 shown in FIG. 8A provided as the first antenna element 81 and second antenna element 82 on a single film sheet 83. The first antenna element 81 has two power feed terminals 93, 94 connected to it, while the second antenna element 82 has two power feed terminals 95, 96 connected to it. The film sheet 83 has a connection part 83A. The loop antenna 14 of the fourth embodiment is mounted on the rear window with this connection part 83A perpendicularly intersecting the electrical heating wires of the defogger 7.

The four power feed terminals 93 to 96 may be connected to a connector 20A provided with four connection terminals 35 to 38. The electrical heating wires of the defogger 7 are positioned between the power feed terminals 93, 94 and between the power feed terminals 95, 96, so the connector 20A connecting these is provided with a recess 25 for avoiding the defogger 7.

Figure 9A:
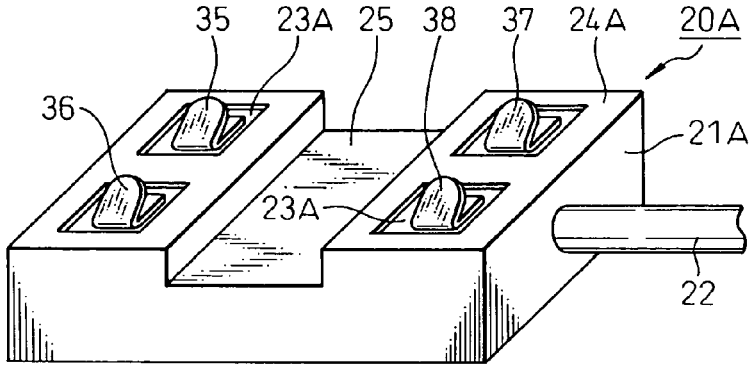
FIG. 9A is a perspective view showing the appearance of a connector part and coaxial cable connected to a power feed terminal of a loop antenna of the present invention shown in FIGS. 8A and 8B.

FIG. 9A shows the appearance of the connector connecting to the power feed terminals 93 to 96 of the loop antenna of the present invention 14 shown in FIGS. 8A, 8B. The bottom (surface for mounting to antenna) of the housing 21A of the connector 20A has four openings 23A. Connection terminals 35 and 38 having springiness stick out from these openings 23A. The connection terminals 34 to 38 are attached to a circuit board (dielectric board) 30A built in the housing 21A. This circuit board 30A is connected to a coaxial cable 22.

The connector 20A is attached at the bottom 24A to the four power feed terminals 93 to 96 shown in FIGS. 8A and 8B using two-sided tape or other adhesive. In this embodiment, the connection terminals 36 and 38 are terminals at the hot side (signal transmission side), while the connection terminals 35 and 37 are terminals of the ground side.

Figure 9B:
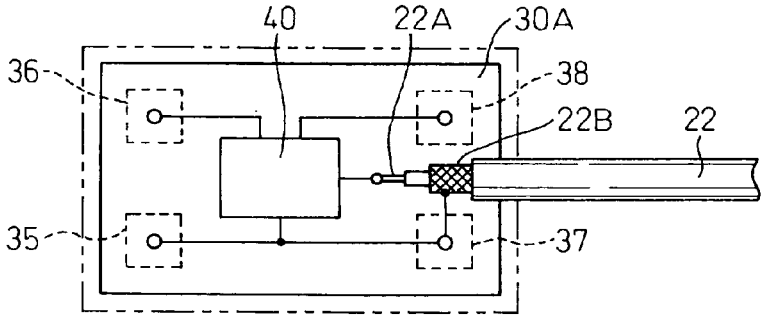
FIG. 9B is a plan view showing the configuration of a circuit board at the inside of the connector shown in FIG. 9A.

FIG. 9B shows the configuration of the circuit board 30A inside the connector 20A shown in FIG. 9A minus the housing 21A. The connection terminals 35 to 38 are attached to the back surface of the circuit board 30A, are guided through the through holes to the front surface of the circuit board 30A, and are connected to the circuit (integrated circuit) 40 mounted on the front surface of the circuit board 30A. The coaxial cable 22 is connected at its center conductor 22A to the circuit 40 and is connected at its ground wire 22B to the connection terminals 35, 37 on the ground side of the circuit board 30A.

Figure 9C:
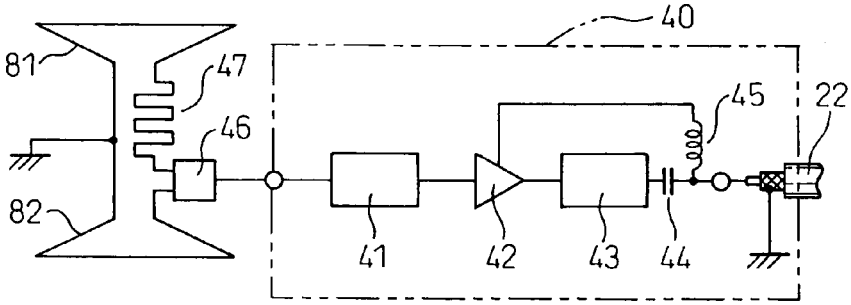
FIG. 9C is a block circuit diagram showing the internal configuration of the circuit shown in FIG. 9B.

FIG. 9C shows the internal configuration of the circuit 40 shown in FIG. 9B and the connection of the first and second antenna elements 81, 82. Inside the circuit 40, there are a filter 41 connected to a divider/combiner 46, an amplifier 42 amplifying the signal output from the filter 41, and a filter 43 determining the signal band output from the amplifier 42. This filter 43 is connected to the center conductor of the coaxial cable 22 through a capacitor 44 blocking a direct current. This coaxial cable 22 is a cable including a power line. The power source voltage is run through a coil 45 (blocking alternating current component) and supplied to the amplifier 42.

The divider/combiner 46 has the second antenna element 82 connected to it as is. The first antenna element 81 has a delay circuit 47 (extension of current carrying line) connected to it for matching the phases of the received signals of the two antennas. Accordingly, the signals received by the first and second antenna elements 81, 82 are combined and input to the circuit 40 in the state with the phases matched.

Figure 9D:
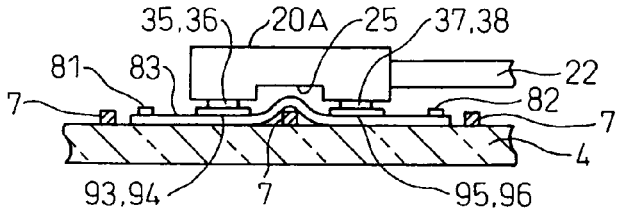
FIG. 9D is a cross-sectional view showing the state of the connector shown in FIG. 9A attached to connection terminals of a loop antenna provided on the rear window.

FIG. 9D shows the state with the connector 20A shown in FIG. 9A mounted on the sheet-like film 83 of the loop antenna 14 provided on the rear window 4 and with the connection terminals 35 to 38 connected to the power feed terminals 93 to 96. The sheet-like film 83 has the part straddling the defogger 7 raised up, but this raised part is accommodated in the recess 25 provided at the connector 20A, so the connector 20A is not obstructed by the defogger 7 from being mounted on the sheet-like film 83.

Figure 10A:
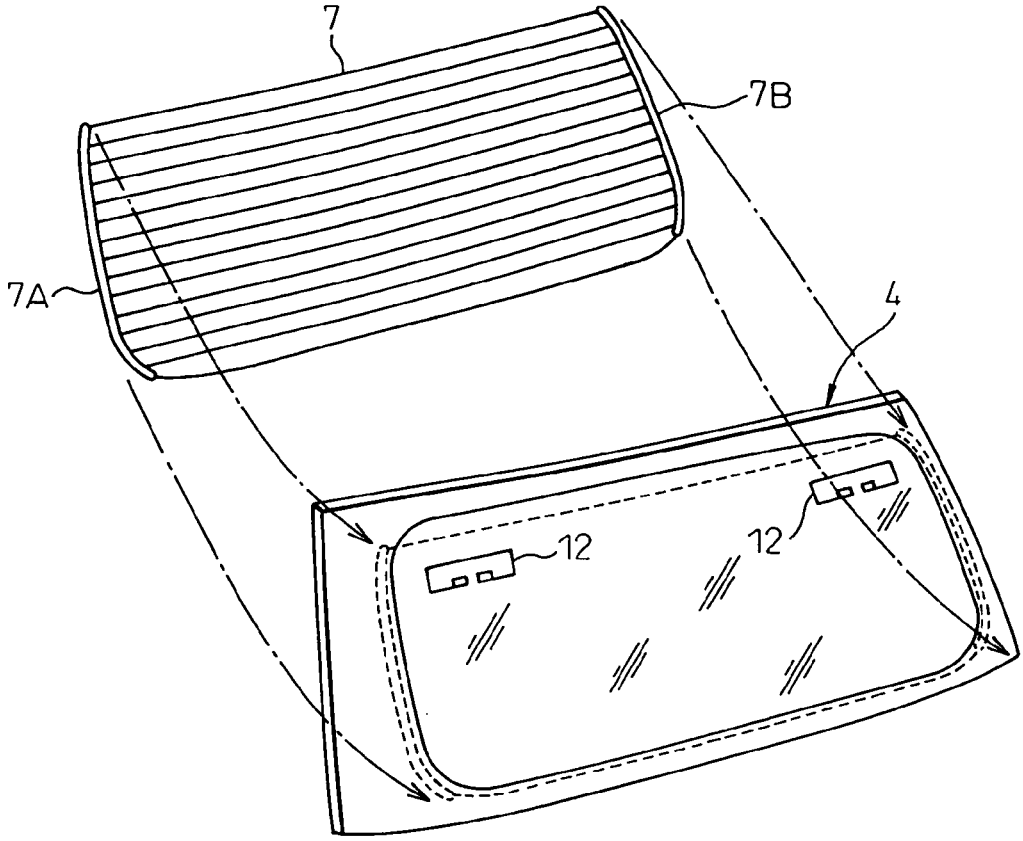
FIG. 10A is an assembled perspective view showing the state of attaching a defogger to a rear window provided with the loop antennas of the present invention.

FIG. 10A shows the state of the defogger 7 mounted on the rear window 4 in which the loop antenna 12 of the second embodiment of the present invention is built. Further, in the case of an antenna built in the rear window, antenna elements configured by thin electrical conductors are embedded in the glass at the time of formation. The position where the defogger 7 will be mounted on the rear window 4 is determined in advance as shown by the broken lines, so the loop antennas 12 are embedded in the rear window 4 at positions where the electrical heating wires of the defogger 7 are arranged. In this case, the power feed terminals of the loop antennas 12 are of course exposed at the inside of the rear window 4. Further, the defogger 7 may also be built into the rear window like the loop antennas 12.

Figure 10B:
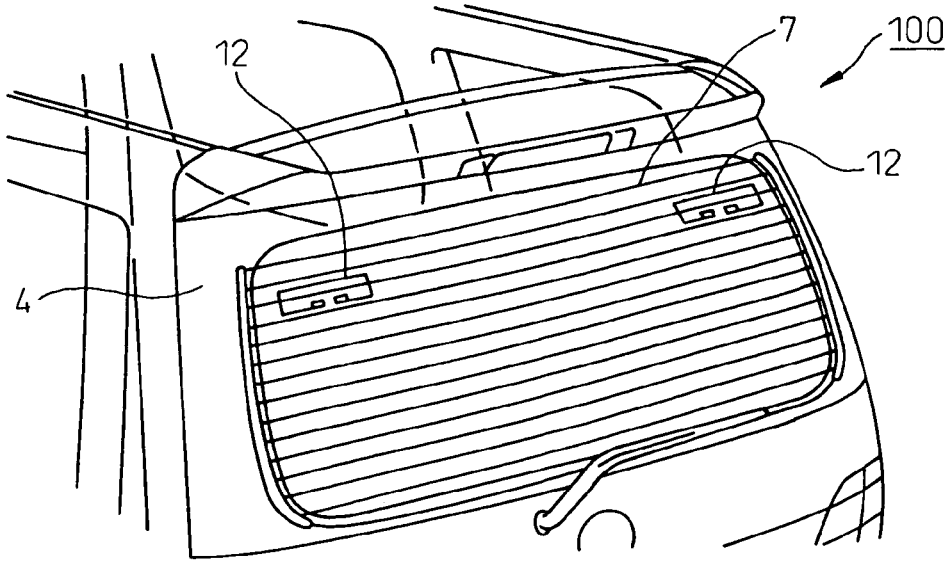
FIG. 10B is a perspective view partially showing the rear of an automobile mounting the rear window of FIG. 10A.

FIG. 10B shows part of the rear of an automobile 100 with the rear window 4 of FIG. 10A. In this way, the loop antennas of the present invention can be built into the rear window 4 provided with the defogger 7.

Here, several specific embodiments of the case of mounting the loop antennas of the present invention on an actual vehicle will be explained.

Figure 11A:
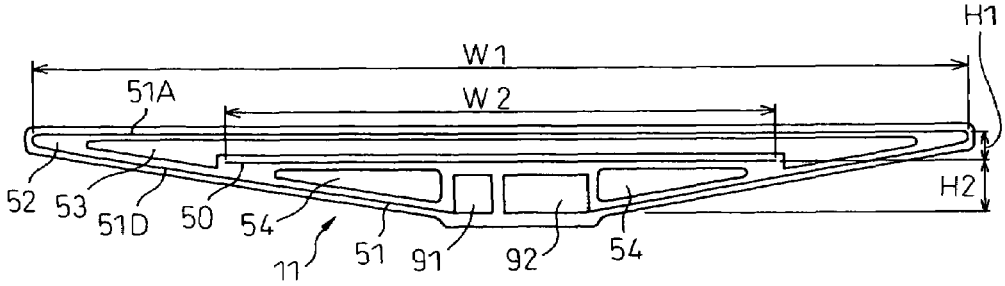
FIG. 11A is a plan view showing the configuration of a specific example of a loop antenna of a modified embodiment of the first embodiment of the present invention shown in FIG. 3B.

FIG. 11A shows an example of a specific configuration of a loop antenna 11 of a modified embodiment of the first embodiment of the present invention shown in FIG. 3B. Accordingly, components the same as the loop antenna 11 of the modified embodiment of the first embodiment are assigned the same notations. In the specific configuration as well, is comprised of a transparent flexible triangular shaped sheet-like film 52 on which a triangular shaped antenna element 51, a nonpower feed terminal 50, and power feed terminals 91, 92 are provided. Further, the sheet-like film 52 at the part between the bottom 51A of the antenna element 51 and the nonpower feed terminal 50 and the parts between the inclined sides 51D of the antenna element 51 and the nonpower feed terminal 50 are provided with openings 53, 54. These openings 53, 54 are provided to prevent air from entering between the sheet-like film 52 and the rear window when the loop antenna 11 is attached to the rear window.

Further, in this example of the specific configuration, the length W1 of the antenna element 51 is 175 mm, the length W2 of the nonpower feed terminal 50 is 105 mm, the length H1 between the bottom 51A of the antenna element 51 and the nonpower feed terminal 50 is 5.5 mm, and the length H2 between the nonpower feed terminal 50 and the ends of the power feed terminals 91, 92 is 9.5 mm. This configuration of loop antenna 11 is for receiving the horizontal polarized wave of the frequency band of digital TV (470 MHz to 710 MHz). The antenna can receive a low frequency of the 500 MHz band at the part of the antenna element 51, while can receive the high frequency of the 600 MHz band at the part of the nonpower feed terminal 50.

The wave of digital TV is a horizontal polarized wave, so by arranging the bottom 51A of the loop antenna element 51 in the horizontal direction and changing the length W1 of this bottom 51A and the length W2 of the nonpower feed terminal 50 arranged inside the loop antenna element 51, it is possible to shift the received bands of the loop antenna element 51 and nonpower feed terminal 50. Further, if making the length W2 of the nonpower feed terminal 50 longer than 105 mm, the frequency which can be received by the part of the nonpower feed terminal 50 becomes lower and if making the length W2 of the nonpower feed terminal 50 shorter than 105 mm, the frequency which can be received becomes higher. Further, if making the length W1 of the bottom 51A of the loop antenna elements 51 and the length W2 of the nonpower feed terminal 50 the same length, the two can receive the same frequency.

For example, to enable reception of a frequency close to 470 MHz of the wave of the frequency band of digital TV (470 MHz to 710 MHz), the length W1 of the bottom 51A of the loop antenna element 51 and the length W2 of the nonpower feed terminal 50 may both be made about 175 mm. To enable reception of a frequency close to 710 MHz, the length W1 of the bottom 51A of the loop antenna element 51 and the length W2 of the nonpower feed terminal 50 may both be made about 80 mm. Further, if making the length W1 of the bottom 51A of the loop antenna element 51 and the length W2 of the nonpower feed terminal 50 different, it is possible to enable a single loop antenna to receive different frequency bands.

Therefore, while not shown in this embodiment, if arranging a nonpower feed terminal shorter than the length of the bottom of the loop antenna in parallel to the bottom at the inside of the loop of a single loop antenna bottom and arranging a nonpower feed terminal longer than the length of the bottom of the loop antenna in parallel to the bottom at the outside of the loop of the loop antenna, a band of a frequency higher than the received band of the loop antenna and a band of a frequency lower than it can be received, so the received band of a single loop antenna can be broadened.

Figure 11B:
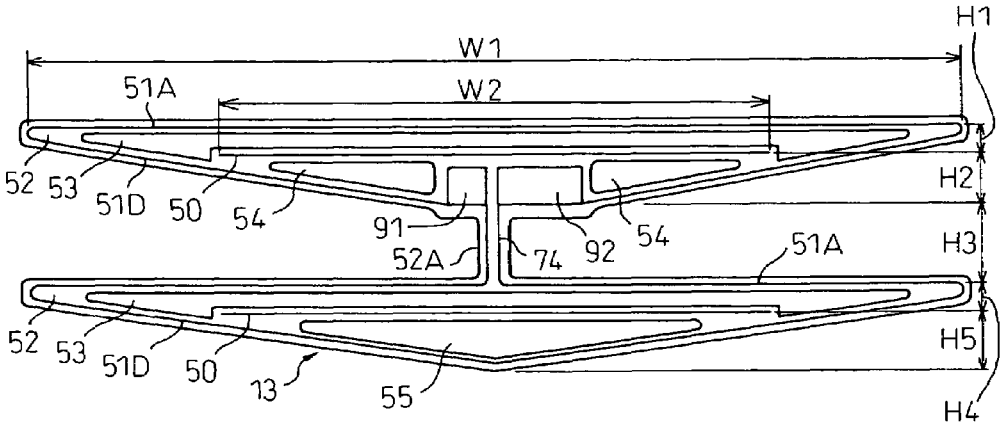
FIG. 11B is a plan view showing the configuration of a specific example of a loop antenna of the third embodiment shown in FIG. 6A and shows a loop antenna attached to the left side of a rear window.

FIG. 11B shows the configuration of a specific example of a loop antenna 13 of a third embodiment shown in FIG. 6A. Accordingly, this is explained while assigning components the same as in the loop antenna 13 of the third embodiment the same notations. In the embodiment shown in FIG. 6A, the sheet-like film 72 was pentagonal in shape, but in the specific example, it has the shape of triangular shaped sheet-like films 52 shown in FIG. 11A connected at a connecting part 52A. However, the lower triangular shaped sheet-like film 52 is not provided with power feed terminals, so the openings 54 at the two sides of the power feed terminals 91, 92 in the upper triangular shaped sheet-like film 52 are formed as a single large opening 55. The openings 53 to 55 are provided to prevent air from entering between the sheet-like films 52 and the rear window when adhering the loop antenna 13 to the rear window.

In the example of the specific configuration shown in FIG. 11B as well, the length W1 of the antenna element 51 is 175 mm, and the length W2 of the nonpower feed terminal 50 is 105 mm. Further, the length H1 between the bottom 51A of the upper antenna element 51 and the nonpower feed terminal 50 and the length H4 between the bottom 51A of the lower antenna element 51 and the nonpower feed terminal 50 are both 5.5 mm. Further, the length H2 between the upper nonpower feed terminal 50 and the ends of the power feed terminals 91, 92 and the length H5 from the lower nonpower feed terminal 50 to the intersection of the inclined sides 51D are both 9.5 mm. Further, the length H3 between the ends of the upper power feed terminals 91, 92 and the lower bottom 51A is 15 mm.

The loop antenna 13 of the configuration of FIG. 11B also receives the horizontal polarized wave of the frequency band of digital TV (470 MHz to 710 MHz). In this specific example, it is possible to receive a low frequency of the 500 MHz band by the part of the antenna element 51 and to receive a high frequency of the 600 MHz band by the part of the nonpower feed terminal 50. Note that the loop antenna 13 of this embodiment is for attachment to the inside surface of the left side of the rear window of the automobile.

Figure 11C:
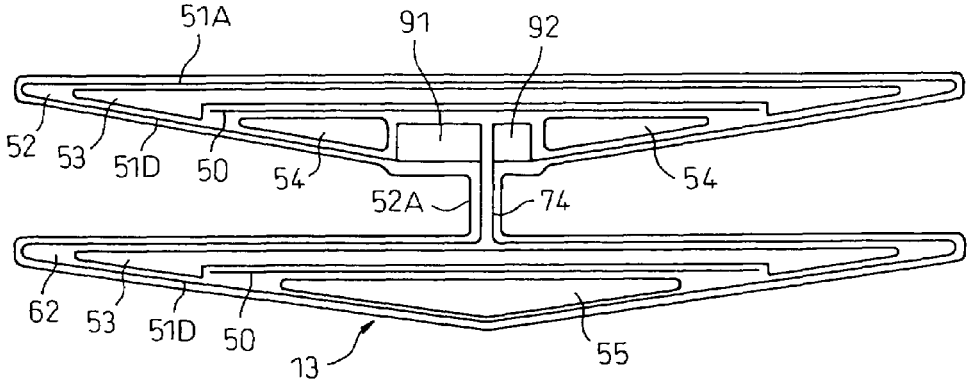
FIG. 11C, similar to FIG. 11B, is a plan view showing the configuration of a specific example of a loop antenna of the third embodiment shown in FIG. 6A and shows a loop antenna attached to the right side of a rear window.

On the other hand, the loop antenna 13 shown in FIG. 11C is for attachment to the inside surface of the right side of the rear window of the automobile. The only point where the loop antenna 13 shown in FIG. 11C differs from the loop antenna 13 shown in FIG. 11B is the shape of the power feed terminals 91, 92. The loop antenna 13 shown in FIG. 11C is assigned the same notations as in FIG. 11B and explanations are omitted.

Figure 12A:
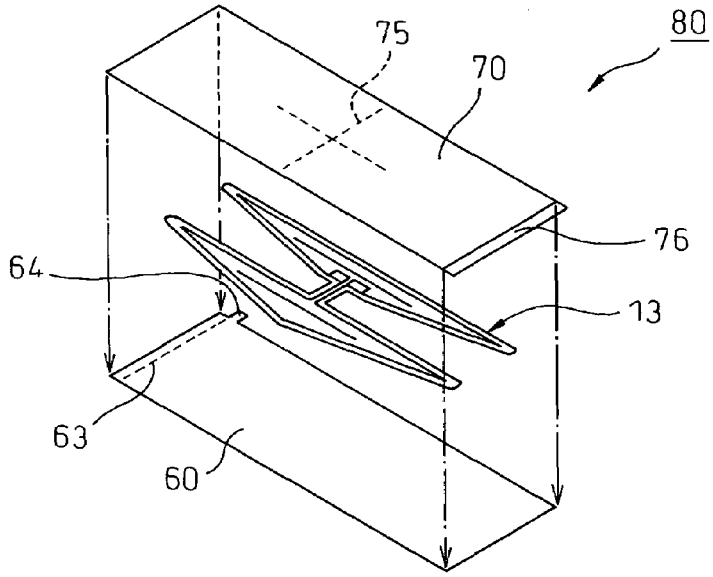
FIG. 12A is an assembled perspective view showing the state of attaching a separator and applicator to a loop antenna shown in FIG. 11B to form a loop antenna assembly.
Figure 12B:
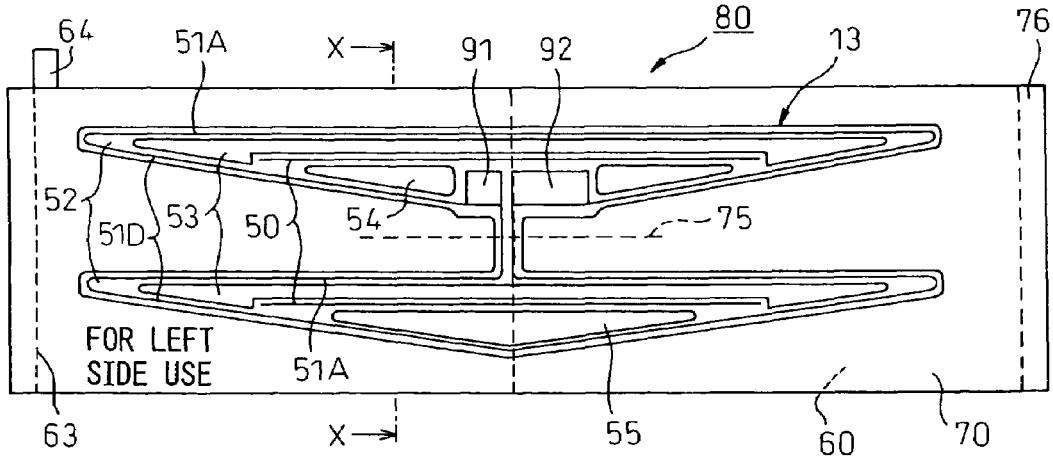
FIG. 12B is a plan view of a loop antenna assembly of FIG. 11A.

FIG. 12A shows the state of laminating an adhesive material on a surface of the loop antenna 13 shown in FIG. 11B for mounting to the rear window of the automobile, then attaching a release paper liner comprised of a separator 60 and an attachment use film comprised of an applicator 70 to configure a loop antenna assembly 80. Further, FIG. 12B is a plan view of this loop antenna assembly 80. In this specific example, the separator 60 and the applicator 70 are transparent films of rectangular shapes larger than the outer shape of the loop antenna 13. The separator 60 is attached to the surface of the loop antenna 13 where the adhesive material is laminated, while the applicator 70 is overlaid on the separator 60 across the loop antenna 13. An adhesive material is laminated on the overlay surface of the applicator 70.

One end of the separator 60 in the longitudinal direction, in this specific example, the left end, is provided with a tear away line 63 enabling part of the separator 60 to be torn off in a strip. Further, one long side of the separator 60 is provided with a tab 64 at a part adjoining the tear away line 63.

The applicator 70 is printed on its surface with positioning marks 75 for the loop antenna 13. The positioning marks, in this specific example, are perpendicularly intersecting bold broken lines. In this embodiment, eleven 3 mm×1 mm dots are printed. The intersection of the broken lines is set corresponding to the center point of the loop antenna 13. Further, one end of the applicator 70 is formed longer than the separator 60 to form an edge part 76. The back surface of this edge part 76 does not have any adhesive material laminated on it. Further, in this specific example, the words "for left side" are printed on the surface of the applicator 70 to show that the loop antenna 13 is for attachment to the left side of the rear window of the automobile.

Figure 12C:
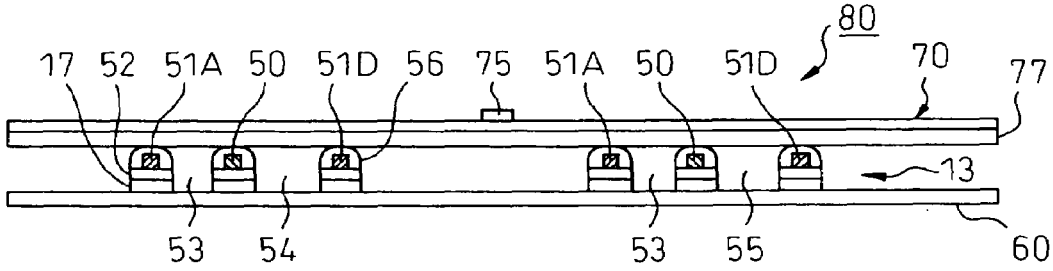
FIG. 12C is a local cross-sectional view along the line X-X of FIG. 11B.

FIG. 12C shows a local cross-section along the line X-X of FIG. 12B and shows the structure of the loop antenna assembly 80. Note that in this figure, the dimensions in the thickness direction are shown enlarged to enable the configuration to be more easily understood. The separator 60 is provided with properties enabling it to stick to the adhesive material, but be easily peeled off. This separator 60 has the adhesive material 17 laminated on the bottom of the sheet-like film 52 of the loop antenna 13 stuck onto it.

The antenna pattern 51 formed on the sheet-like film 52 of the loop antenna 13 (in this figure, the bottom 51A and inclined sides 51D shown) and the nonpower feed terminal 50 are generally formed on copper foil. This copper foil is protected by being covered by a protective material 56. On the separator 60, the applicator 70 is adhered over the loop antenna 13. In this figure, the separator 60 and the applicator 70 are shown separated, but in actuality the adhesive material 77 laminated on the back surface of the applicator 70 sticks to the separator 60. On the surface of the applicator 70, positioning marks 75 are printed. Note that the adhesive power of the adhesive material 17 of the loop antenna 13 is stronger than the adhesive power of the adhesive material 77 of the applicator 70.

Next, the procedure for using the left side use loop antenna assembly 80 shown from FIGS. 12A to 12C to adhere the loop antenna 13 to the left side of the rear window 4 of the automobile from the inside will be explained using FIG. 13A to FIG. 14D.

Figure 13A:
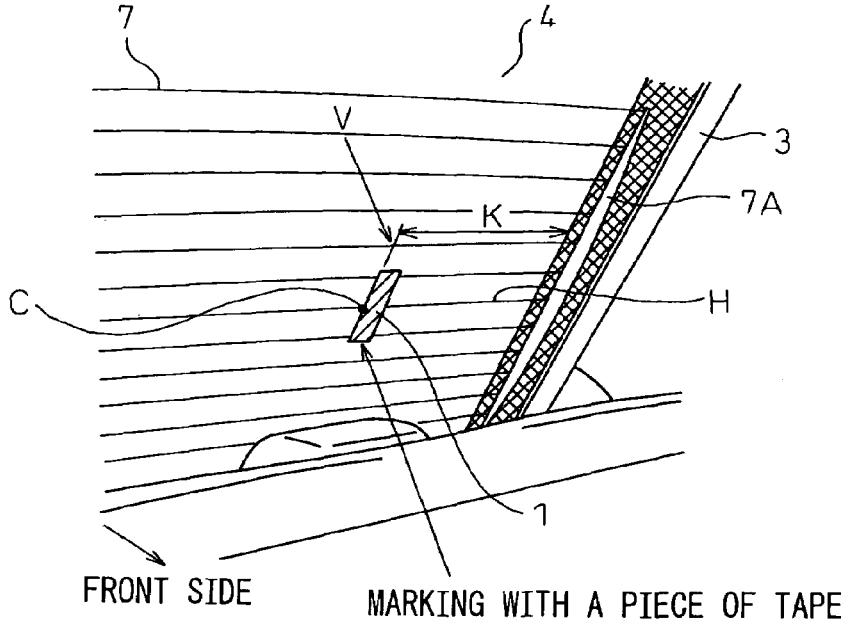
FIG. 13A is a perspective view explaining the procedure for mounting the left side loop antenna assembly shown in FIG. 12B and showing the state of the masking tape for determining the position for mounting of the loop antenna attached to the rear window.

FIG. 13A shows the left side of the rear window 4 of an automobile where a loop antenna is mounted. The rear window 4 is provided with a defogger 7. A plurality of electrical heating wires are arranged in the horizontal direction with respect to the ground surface. The loop antenna has to be kept from overlapping the rear pillar 3 and the electrodes 7A of the defogger 7 of the automobile. Therefore, in accordance with the instructions for installation attached to the antenna set, a position exactly a predetermined distance K from the electrode 7A on a predetermined electrical heating wire of the defogger 7 is set as the reference point C and this reference point C is marked. This reference point C is the point becoming the center of the loop antenna (intersection of positioning marks 75 of loop antenna assembly 80 explained in FIG. 12).

For the marking, a line is drawn passing through the reference point C vertical to the electrical heating wire of the defogger 7. An oil-based felt pen may be used to drawn the line, but the line would remain even after attachment of the antenna, so usually a predetermined length of masking tape 1 is used. The masking tape 1 is adhered in a direction perpendicularly intersecting the electrical heating wire of the defogger 7 so that one side passes through the reference point C. In this case, the side of the masking tape 1 passing through the reference point C becomes the vertical direction reference line V, while the electrical heating wire of the defogger 7 passing through the reference point C becomes the horizontal direction reference line H.

Figure 13B:
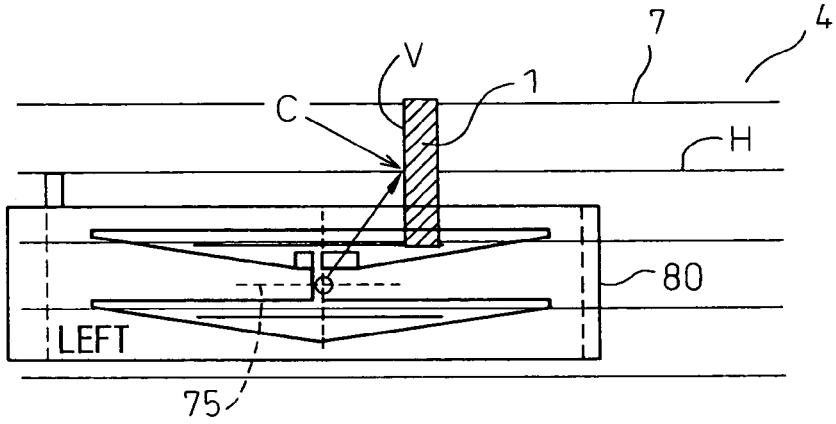
FIG. 13B is a view explaining the procedure for mounting the left side loop antenna assembly shown in FIG. 12B to the left side of the rear window of the automobile from the inside and explains the procedure for positioning the loop antenna assembly while aligning the positioning marks at the loop antenna assembly with the masking tape on the rear window.
Figure 13C:
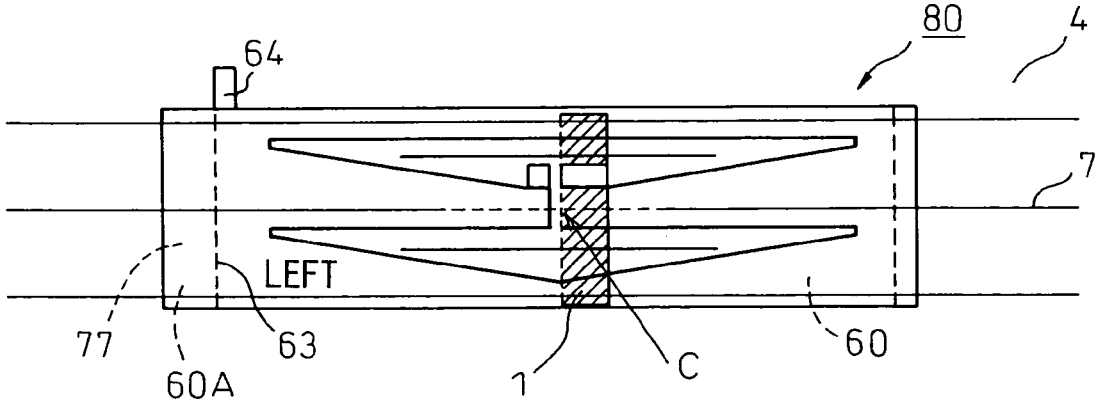
FIG. 13C is a front view showing a loop antenna assembly positioned with respect to the masking tape on the rear window by the procedure of FIG. 13B.

After the masking tape 1 is adhered to a predetermined position of the rear window 4, as shown in FIG. 13B, the loop antenna assembly 80 is laid over the rear window 4 to obtain the state shown in FIG. 13C using the masking tape 1 on the rear window 4 as a point of reference so that the intersection of the positioning marks 75 of the loop antenna assembly 80 is aligned with the reference point C, the horizontal line with the reference line H, and the vertical line with the reference line V.

Next, in the state of FIG. 13C, the left side of the loop antenna assembly 80 is lifted up, the end 60A of the separator 60 is torn off along the tear away line 63, the adhesive material 77 of the back surface of the end 70A of the applicator 70 is exposed at just the torn away part (see FIG. 12C), and the loop antenna assembly 80 is provisionally fastened on the rear window 4 by the adhesive material 77 of this end 70A.

Figure 14A:
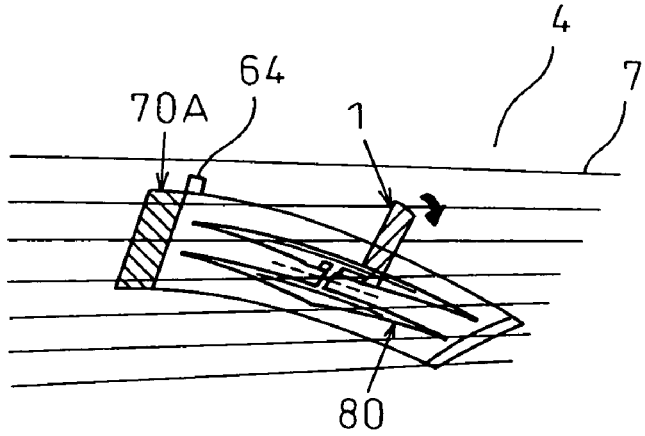
FIG. 14A is a view explaining the procedure for mounting the left side loop antenna assembly shown in FIG. 12B to the left side of the rear window of the automobile from the inside and explains the procedure for removing part of the separator from the state of FIG. 13C, adhering the adhesive material coated on the back surface of the applicator to the rear window, and removing the masking tape.

After the loop antenna assembly 80 is provisionally fastened on the rear window 4, as shown in FIG. 14A, the right side of the loop antenna assembly 80 provisionally fastened to the rear window 4 by the adhesive material 77 of the end 70A is lifted up and the masking tape 1 is removed from the rear window 4.

Figure 14B:
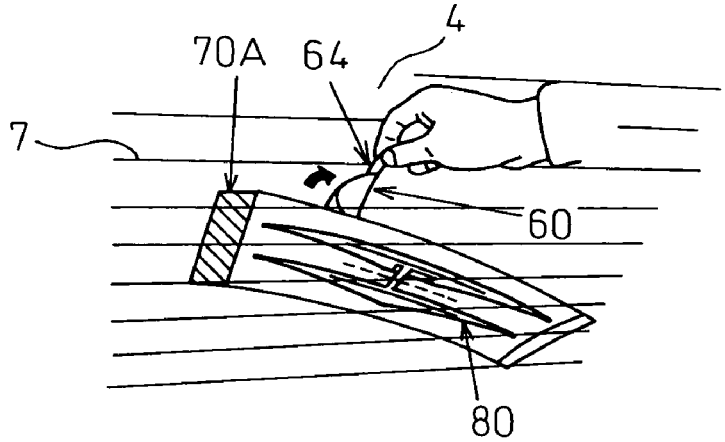
FIG. 14B is a view explaining the procedure for mounting the left side loop antenna assembly shown in FIG. 12B to the left side of the rear window of the automobile from the inside and explains the procedure for removing all of the separator from the state of FIG. 14A and adhering the loop antenna to the rear window for each applicator.

Next, as shown in FIG. 14B, the tab 64 of the separator 60 is gripped and the separator 60 is peeled off. When the separator 60 is peeled off, at the surface of the loop antenna assembly 80 facing the rear window, the adhesive material 17 of the loop antenna 13 and the adhesive material 77 of the applicator 70 are exposed, so these adhesive materials 17, 77 are used to adhere the loop antenna assembly 80 to the rear window 4. At this time, the loop antenna assembly 80 is adhered to the rear window 4 so that the horizontal line of the positioning mark 75 of the applicator 70 overlaps the electrical heating wire of the defogger 7.

Figure 14C:
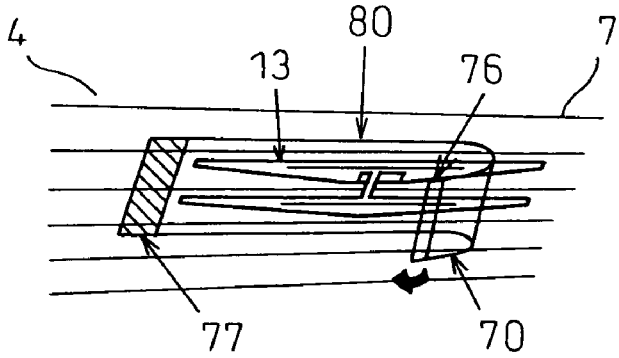
FIG. 14C is a view showing the procedure for removing the applicator from the loop antenna adhered to the rear window by the procedure of FIG. 14B.
Figure 14D:
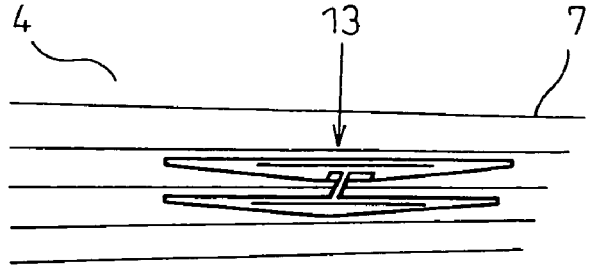
FIG. 14D is a view showing the state with the applicator removed by the procedure of FIG. 14C and with only the loop antenna adhered to the rear window.

After the loop antenna assembly 80 is attached to the rear window 4, as shown in FIG. 14C, the edge part 76 of the applicator 70 is pulled to peel off the applicator 70 from the rear window 4. As a result, as shown in FIG. 14D, the loop antenna 13 is attached to a suitable position of the rear window 4.

Above, examples of mounting a loop antenna according to embodiments of the present invention on the rear window of an automobile were explained, but the loop antenna of the present invention may be mounted not only on the rear window of an automobile, but also another window of a vehicle or a window of a house. Further, the rear window of an automobile is sometimes provided with not only a defogger, but also a printed antenna for receiving waves of the FM band or other waves. In this case as well, the loop antenna of the present invention can be provided at the region where the defogger is provided, so will not be affected by other antennas mounted on the rear window.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

What is claimed is:

1. A loop antenna mounted on a sheet of glass provided with a defogger comprised of a plurality of electrical heating wires bridging it in a horizontal direction, provided with an antenna element arranged in a polygonal shape, including a triangle, and forming a loop and power feed terminals of said loop antenna provided a predetermined distance from a bottom formed by one side of said antenna element, a distance between said power feed terminals and said bottom being formed smaller than a distance between adjoining electrical heating wires, said loop antenna able to be mounted to said glass sheet between said adjoining electrical heating wires.

2. A loop antenna as set forth in claim 1, wherein a total length of said antenna element forming said loop is formed to a length equivalent to one wavelength of a frequency which said loop antenna sends and receives, and a wire conductor parallel to said bottom and independent from said loop antenna is provided at least at one of an inside and outside of said loop near said bottom.

3. A loop antenna as set forth in claim 2, wherein said wire conductor is arranged so that a midpoint of said wire conductor is positioned on a line connecting a point between two power feed terminals of said loop antenna and a midpoint of said bottom.

4. A loop antenna as set forth in claim 2, wherein a total length of said wire conductor is formed to be ½ of the total length of the antenna element forming said loop.

5. A loop antenna as set forth in claim 1, wherein a total length of said antenna element forming said loop is formed to a length equivalent to one wavelength of a center frequency of a frequency band which said loop antenna sends and receives, and a wire conductor parallel to said bottom and independent from said loop antenna is provided at least at one of an inside and outside of said loop near said bottom.

6. A loop antenna as set forth in claim 5, wherein said wire conductor is arranged so that a midpoint of said wire conductor is positioned on a line connecting a point between two power feed terminals of said loop antenna and a midpoint of said bottom.

7. A loop antenna as set forth in claim 5, wherein a total length of said wire conductor is formed to be ½ of said total length of said antenna element forming said loop.

8. A method of mounting a loop antenna to a rear window of a vehicle equipped with a defogger comprised of a plurality of electrical heating wires bridging it in a horizontal direction, comprising forming a loop antenna as set forth in claim 1 on a single flexible dielectric sheet and providing one surface of said dielectric sheet with an adhesive material over its entire area and adhering said loop antenna, through said adhesive material, to an inside surface of said rear window at a region between adjoining electrical heating wires so that an antenna element positioned at a bottom runs along one of the electrical heating wires.

9. A loop antenna mounted on a sheet of glass equipped with a defogger comprised of a plurality of electrical heating wires bridging it in a horizontal direction, provided with:

an antenna element provided with a bottom and two sides provided at said two sides of this bottom and extending vertically with respect to said bottom in said same direction and arranged in a polygonal shape with at least four sides to form a loop and two power feed terminals of said loop antenna provided at a position a predetermined distance from said bottom, a distance between said power feed terminals and said bottom being formed larger than a distance between adjoining electrical heating wires, said loop antenna able to be mounted on said glass sheet in a state with said sides perpendicularly intersecting said electrical heating wires.

10. A loop antenna as set forth in claim 9, wherein a total length of an antenna element forming said loop is formed to a length equivalent to one wavelength of a frequency which said loop antenna sends and receives, and a wire conductor parallel to said bottom and independent from said loop antenna is provided at least at one of an inside and outside of said loop near said bottom.

11. A loop antenna as set forth in claim 10, wherein said wire conductor is arranged so that a midpoint of said wire conductor is positioned on a line connecting a point between two power feed terminals of said loop antenna and a midpoint of said bottom.

12. A loop antenna as set forth in claim 10, wherein a total length of said wire conductor is formed to be ½ of the total length of the antenna element forming said loop.

13. A loop antenna as set forth in claim 9, wherein a total length of an antenna element forming said loop is formed to a length equivalent to one wavelength of a center frequency of a frequency band which said loop antenna sends and receives, and a wire conductor parallel to said bottom and independent from said loop antenna is provided at least at one of an inside and outside of said loop near said bottom.

14. A loop antenna as set forth in claim 13, wherein said wire conductor is arranged so that a midpoint of said wire conductor is positioned on a line connecting a point between two power feed terminals of said loop antenna and a midpoint of said bottom.

15. A loop antenna as set forth in claim 13, wherein a total length of said wire conductor is formed to be ½ of said total length of said antenna element forming said loop.

16. A method of mounting a loop antenna to a rear window of a vehicle equipped with a defogger comprised of a plurality of electrical heating wires bridging it in a horizontal direction, comprising forming a loop antenna as set forth in claim 9 on a single flexible dielectric sheet and providing one surface of said dielectric sheet with an adhesive material over its entire area and adhering said loop antenna, through said adhesive material, to an inside surface of said rear window at a region between two electrical heating wires adjoining one electrical heating wire so that one side perpendicularly intersects said one electrical heating wire.

17. A loop antenna mounted on a sheet of glass equipped with a defogger comprised of a plurality of electrical heating wires bridging it in a horizontal direction, provided with:

a plurality of loop antennas each having a polygonal loop having one side of an antenna element as a bottom and all having said bottoms arranged in parallel, two straight elements parallel to a line vertical to a midpoint of said bottom and connecting adjoining loop antennas, and at least one power feed terminal provided at each of said two sides of said line vertical to said bottom, a total length of an antenna element forming each said loop antenna being formed to a length equivalent to one wavelength of a frequency which said loop antenna sends and receives, a maximum value of a distance from said bottom to another antenna element separated in said vertical direction being smaller than a distance between said electrical heating wires, and said loop antenna able to be mounted to said glass sheet in a state with said straight elements perpendicularly intersecting said electrical heating wires.

18. A loop antenna as set forth in claim 17, wherein wire conductors parallel to said bottom and independent from said loop antennas are provided near said bottoms at the insides of said loops.

19. A method of mounting a loop antenna to a rear window of a vehicle equipped with a defogger comprised of a plurality of electrical heating wires bridging it in a horizontal direction, comprising forming a loop antenna as set forth in claim 17 on a single flexible dielectric sheet and providing one surface of said dielectric sheet with an adhesive material over its entire area and adhering said loop antenna, through said adhesive material, to an inside surface of said rear window at a region between two electrical heating wires adjoining one electrical heating wire so that said straight elements perpendicularly intersect said one electrical heating wire.

20. A method of mounting a loop antenna as set forth in claim 17 to a rear window of a vehicle equipped with a defogger comprised of a plurality of electrical heating wires bridging it in a horizontal direction, comprising laminating an adhesive material on a surface of said loop antenna for mounting to a glass sheet, attaching a release paper liner of a size larger than said loop antenna to said mounting surface, giving said surface of said loop antenna at the opposite side to said mounting side a size enabling overlay on said release paper liner, and overlaying an applicator with an adhesive material laminated on its overlay surface and with intersecting positioning marks printed on the opposite side so as to form a loop antenna assembly, positioning a center of an attachment position of said loop antenna at a point overlaying a predetermined single electrical heating wire among said electrical heating wires, attaching masking tape to said rear window while matching one side of said masking tape to a line vertical to this electrical heating wire passing through the center point so as to set said single electrical heating wire as a horizontal axis and one side of said masking tape as a vertical axis, placing said loop antenna assembly on said rear window in a state with said release liner at the rear window surface side and with said positioning marks aligned with said horizontal axis and vertical axis, removing part of said release liner while holding this state and using the adhesive material of said applicator overlaying the removed part to temporarily fasten said loop antenna assembly on said rear window, removing said masking tape, then peeling off said release paper liner to adhere said loop antenna by said adhesive material to the rear window, and finally peeling off the applicator from said loop antenna.

21. A rear window for securing a rear field of vision of a vehicle, wherein when a defogger with electrodes arranged at the two ends in a vertical direction and with a plurality of electrical heating wires bridging said electrodes in a horizontal direction is mounted at an inside of said rear window, said rear window has at least one of said loop antennas set forth in claims 1, 9, and 17 embedded inside it, in the case of the loop antenna as set forth in claim 1, said loop antenna is embedded, with respect to a mounting position of said defogger in said rear window, in a region between adjoining electrical heating wires of said defogger so that said antenna element positioned at the bottom of said loop antenna runs along said electrical heating wires, in the case of the loop antenna as set forth in claim 9, said loop antenna is embedded, with respect to a mounting position of said defogger in said rear window, in a region between two electrical heating wires adjoining one electrical heating wire of said defogger so that sides of said loop antenna perpendicularly intersect said one electrical heating wire, and in the case of the loop antenna as set forth in claim 18, said loop antenna is embedded, with respect to a mounting position of said defogger in said rear window, in a region between two electrical heating wires adjoining one electrical heating wire of said defogger so that said straight elements of said loop antenna perpendicularly intersect said one electrical heating wire.

* * * * *